US007251973B2

(12) United States Patent
Gharib

(10) Patent No.: US 7,251,973 B2
(45) Date of Patent: Aug. 7, 2007

(54) HYDROFORMING APPARATUS

(76) Inventor: Mohamed T. Gharib, C/o Upland Technologies Inc., 200 Avenue Road, Cambridge, Ontario (CA) N1R 8H5

( * ) Notice: Subject to any disclaimer, the term of this patent is extended or adjusted under 35 U.S.C. 154(b) by 0 days.

(21) Appl. No.: 11/518,443

(22) Filed: Sep. 11, 2006

(65) Prior Publication Data

US 2007/0056341 A1 Mar. 15, 2007

Related U.S. Application Data

(60) Provisional application No. 60/715,581, filed on Sep. 12, 2005.

(51) Int. Cl.
*B21D 26/02* (2006.01)
*B21D 37/14* (2006.01)

(52) U.S. Cl. ..... 72/61; 72/62; 72/58; 29/421.1; 100/231

(58) Field of Classification Search ..... 72/58, 72/59, 61–63, 446, 455, 57; 29/421.1, 455.1, 29/512; 100/231

See application file for complete search history.

(56) References Cited

U.S. PATENT DOCUMENTS

| | | | | |
|---|---|---|---|---|
| 5,600,983 | A * | 2/1997 | Rigsby | 72/61 |
| 6,018,971 | A * | 2/2000 | Kleinschmidt | 72/61 |
| 6,041,633 | A * | 3/2000 | Bieling | 72/61 |
| 6,536,251 | B2 * | 3/2003 | Marando et al. | 72/61 |
| 6,892,560 | B2 * | 5/2005 | Hiramatsu et al. | 72/61 |
| 6,966,209 | B1 * | 11/2005 | Schulze | 72/61 |
| 7,047,780 | B2 * | 5/2006 | Marando et al. | 72/61 |

* cited by examiner

*Primary Examiner*—David B. Jones

(57) ABSTRACT

A hydroforming apparatus for hydroforming a workpiece. The apparatus includes a die in which a die cavity is located, and an outer ring subassembly. The outer ring subassembly is movable relative to the die, and includes a ring and one or more first cam segments attached thereto. The outer ring subassembly also includes one or more second cam segments and one or more tapered wedges positioned between the first and second cam segments. The tapered wedge is movable between an extended position, in which the second cam segment is pushed to an open position in which the second cam segment is engageable with the outer surfaces when the subassembly is proximal to the die, and a retracted position, in which the second cam segment is moved to a closed position by a biasing means. The second cam segment includes a lower surface shaped to engage outer surfaces.

6 Claims, 28 Drawing Sheets

HYDROFORMING APPARATUS

This application claims the benefit of U.S. Provisional Application No. 60/715,581, filed Sep. 12, 2005.

FIELD OF THE INVENTION

This invention is related to a hydroforming apparatus for hydroforming a workpiece.

BACKGROUND OF THE INVENTION

Many parts such as the ones used in automotive structures are manufactured using a hydroforming process. The hydroforming process requires large presses up to 5,000 tons to hold the hydroforming die close during the hydroforming process. These presses are large, expensive, require large amounts of energy to operate and require special and expensive installations, yet the work is done using the hydroforming pressure not the press forces. In an effort to reduce the automotive vehicle weight, high strength steel is being used, which means larger hydroforming presses are required.

Processes such as hydroforming process requires large presses to clamp the die in place while forming is done by other means such as applying internal pressure to form the part.

As shown in FIGS. 2*a* and 2*b*, the hydroforming technique according to the prior art includes providing a die 10 having a lower portion 12 and an upper portion 14 which combine to define a die cavity 16. The upper portion 14 is moved generally downward into a closed position forming a die cavity 16 over a round tube 22. Side plugs 18 and 20 are then moved sideways to engage the tube 22, to seal both ends of tube 22, and a hydraulic pressure source is connected to the interior of tube 22 through an opening 24 inside plugs 18 and 20, thereby expanding tube 22 until it conforms to the shape of the die cavity 16.

The force F required to keep the die 10 closed varies according to the size of the tube 22 and typically is in the magnitude of thousands of tons. In order to supply the force F a large press is used to keep the die 10 closed. For example, the press typically provides a force F of 5,000 tons or more. With reference to FIG. 3, the prior art press is relatively large and expensive. The prior art press often is mounted to a subsurface structure, which is relatively expensive.

SUMMARY OF THE INVENTION

In its broad aspect, the invention provides a hydroforming apparatus for hydroforming a workpiece. The apparatus includes a die and an outer ring subassembly. The die includes a lower die section mounted in a lower die holder and an upper die section mounted in an upper die holder. One of the upper and lower die holders is movable relative to the other between an open position, in which the workpiece is positionable between the upper and lower die holders, and a closed position, in which the lower and upper die sections combine to define a die cavity therebetween in which the workpiece is hydroformed. In addition, each of the upper and lower die holders has an outer surface respectively. The outer ring subassembly includes a ring and one or more first cam segments attached to an inner surface of the ring. The outer ring subassembly also includes one or more second cam segments and one or more tapered wedges positioned between the first and second cam segments. The second cam segment is movable between an open position, in which the second cam segment is positioned distal to the first cam segment, and a closed position, in which the second cam segment is disposed proximal to the first cam segment. The outer ring subassembly also includes one or more biasing means for biasing the second cam segment to the closed position. The tapered wedge is movable between an extended position, in which the second cam segment is pushed by the tapered wedge to the open position, and a retracted position, in which the second cam segment is moved to the closed position by the biasing means. Also, the second cam segment includes a lower surface shaped to engage the outer surface of the upper and lower die holders. In addition, the outer ring subassembly is movable between a forward position, in which the lower surface of the second cam segment engages the outer surface upon the tapered wedge moving to the extended position, and return position, in which the lower surface is disengaged from the outer surface of the upper and lower die holders.

In another aspect, the outer surfaces of the upper and lower die holders cooperate to form a cylindrical shape when the upper and lower die holders are combined.

In another of its aspects, the hydroforming apparatus additionally includes one or more hydraulic cylinders for moving the tapered wedge between the retracted position and the extended position.

In yet another aspect, the hydraulic cylinder exerts a first force directed in a first direction on the tapered wedge to move the tapered wedge to the extended position.

In another aspect, the tapered wedge includes a substantially planar contact surface and the second cam segment includes a substantially planar mating surface. Upon movement of the tapered wedge to the extended position, the contact surface and the mating surface engage each other substantially on a contact plane. The contact plane defines an acute angle between the contact plane and the first direction so that, upon movement of the tapered wedge to the extended position, a second force is transmitted which is directed toward the outer surface, to assist in holding the upper and lower die holders together during hydroforming.

In yet another aspect, the outer ring subassembly is movable along guide rods between a forward position and a returned position.

BRIEF DESCRIPTION OF THE DRAWINGS

The present invention will become more fully understood from the detailed description and the accompanying drawings wherein.

DETAILED DESCRIPTION

Figure 1:
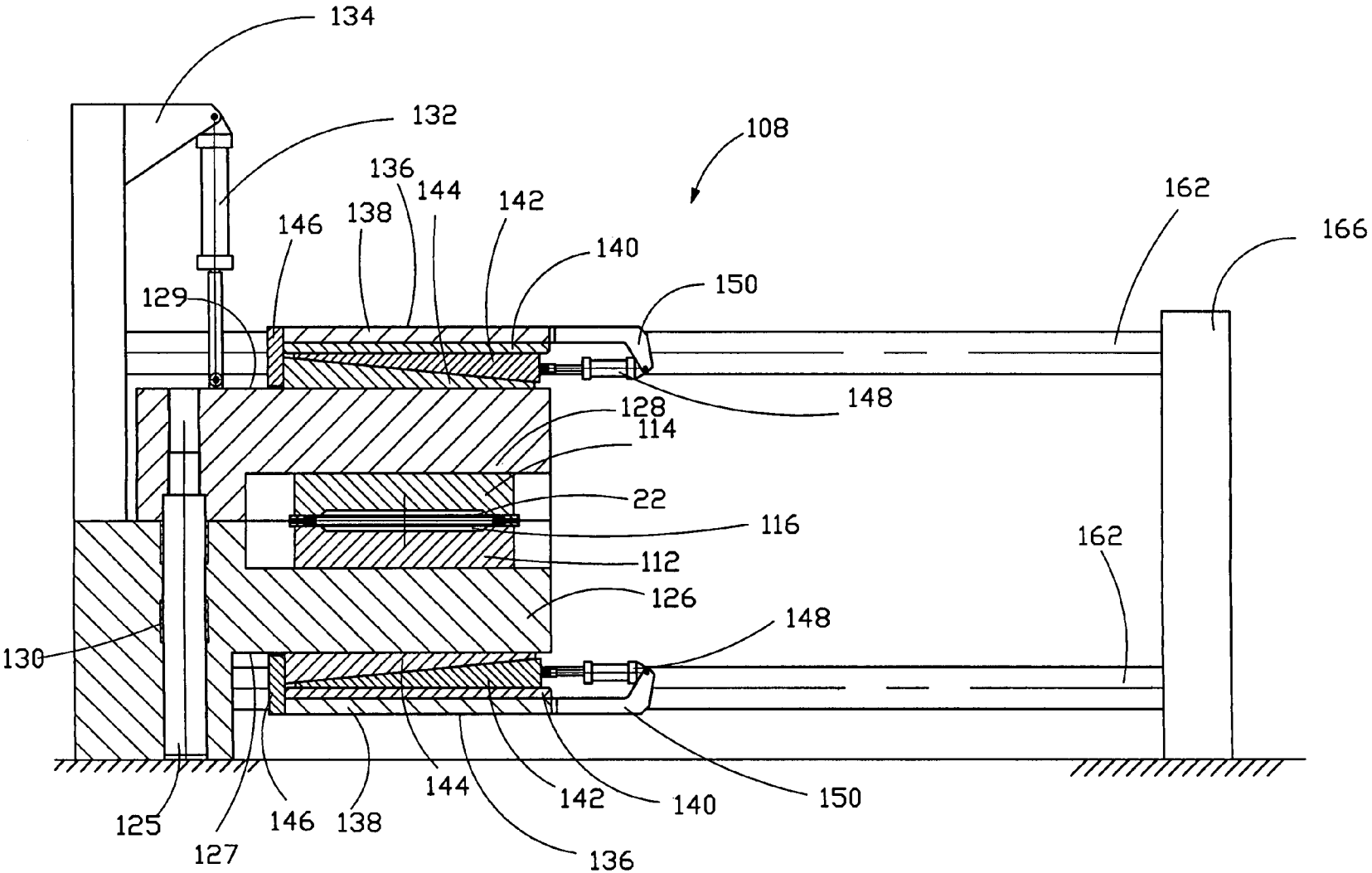
FIG. 1 is a sectional view of a hydroforming apparatus according to the invention showing an outer ring over a die holder.
Figure 2A:
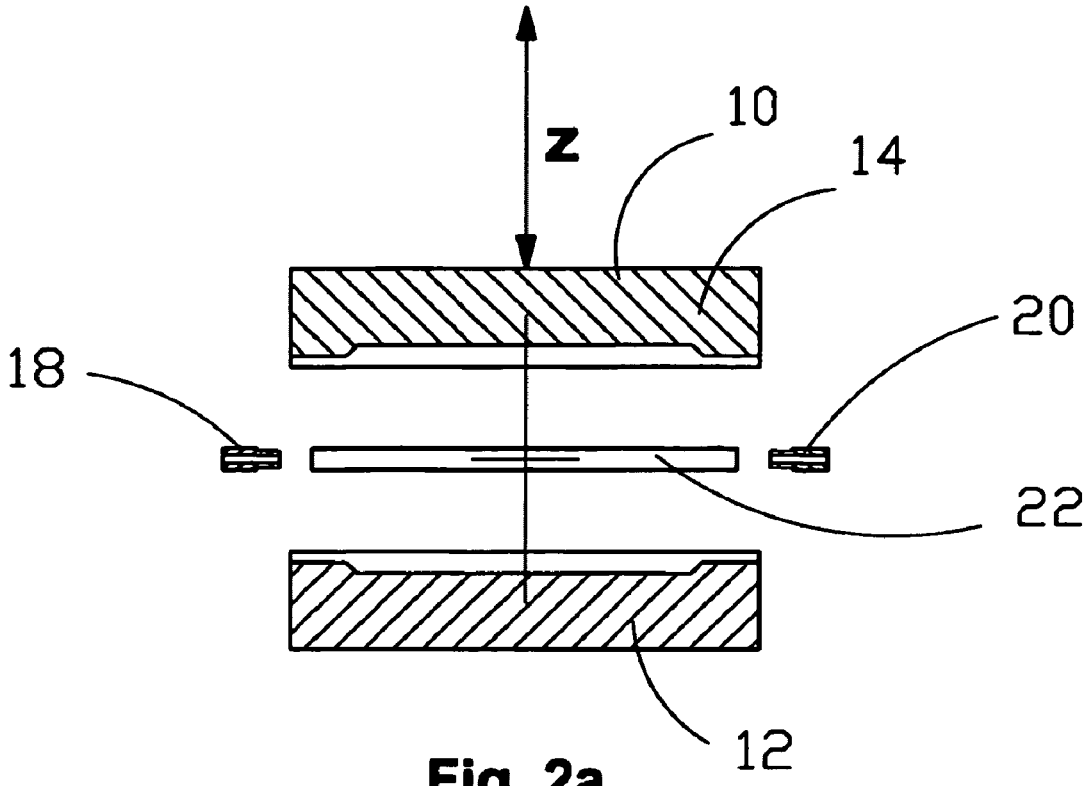
Fig. 2a Prior Art
FIG. 2*a* is a sectional view of a hydroforming apparatus of the prior art showing a prior art hydroforming die in an open position, drawn at a larger scale.
Figure 2B:
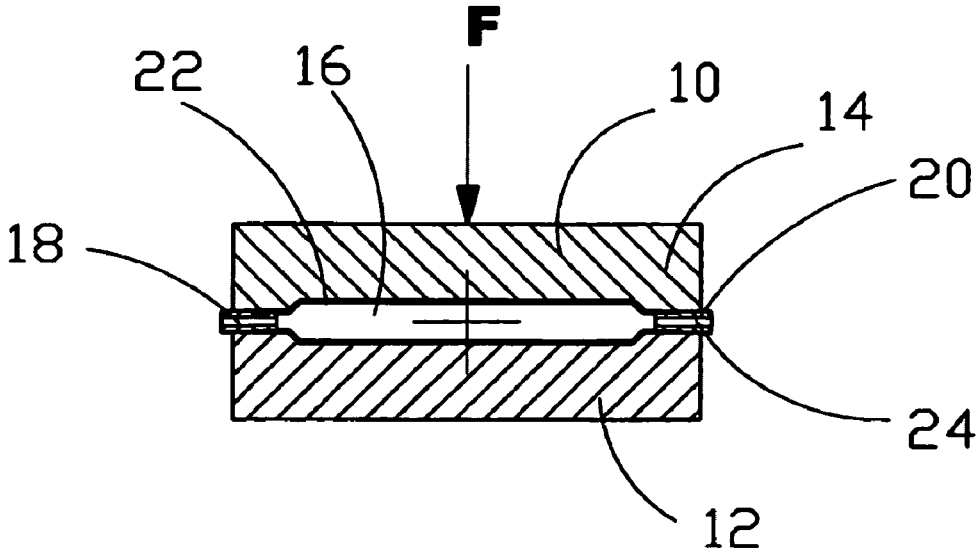
Fig. 2b Prior Art
FIG. 2*b* is a sectional view of the prior art hydroforming apparatus of FIG. 2*a* showing the hydroforming die thereof in a closed position.
Figure 3:
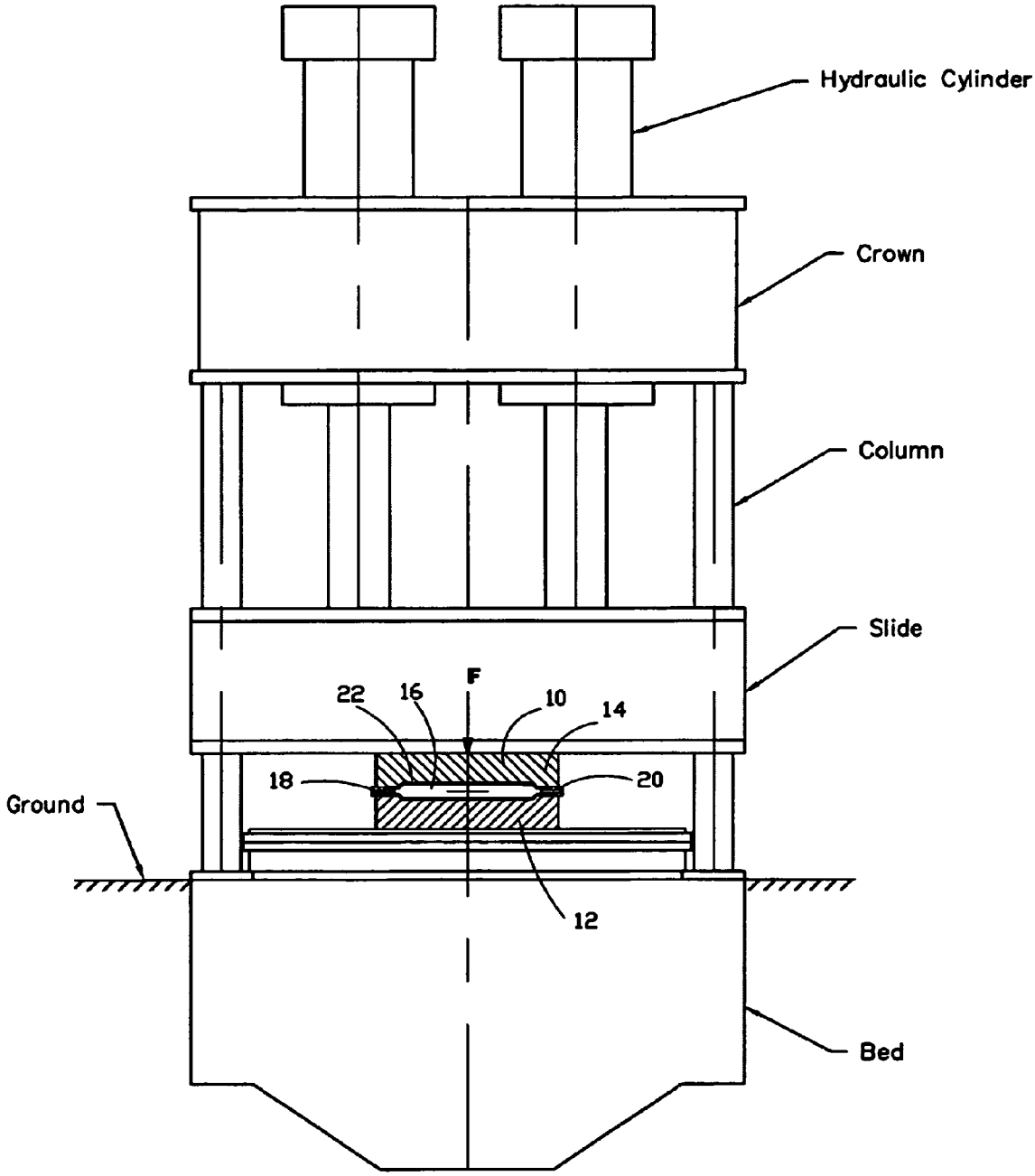
Fig. 3 Prior Art
FIG. 3 is a sectional view of the prior art hydroforming apparatus of FIGS. 2*a* and 2*b* showing the hydroforming die in a hydroforming press, drawn at a smaller scale.
Figure 4:
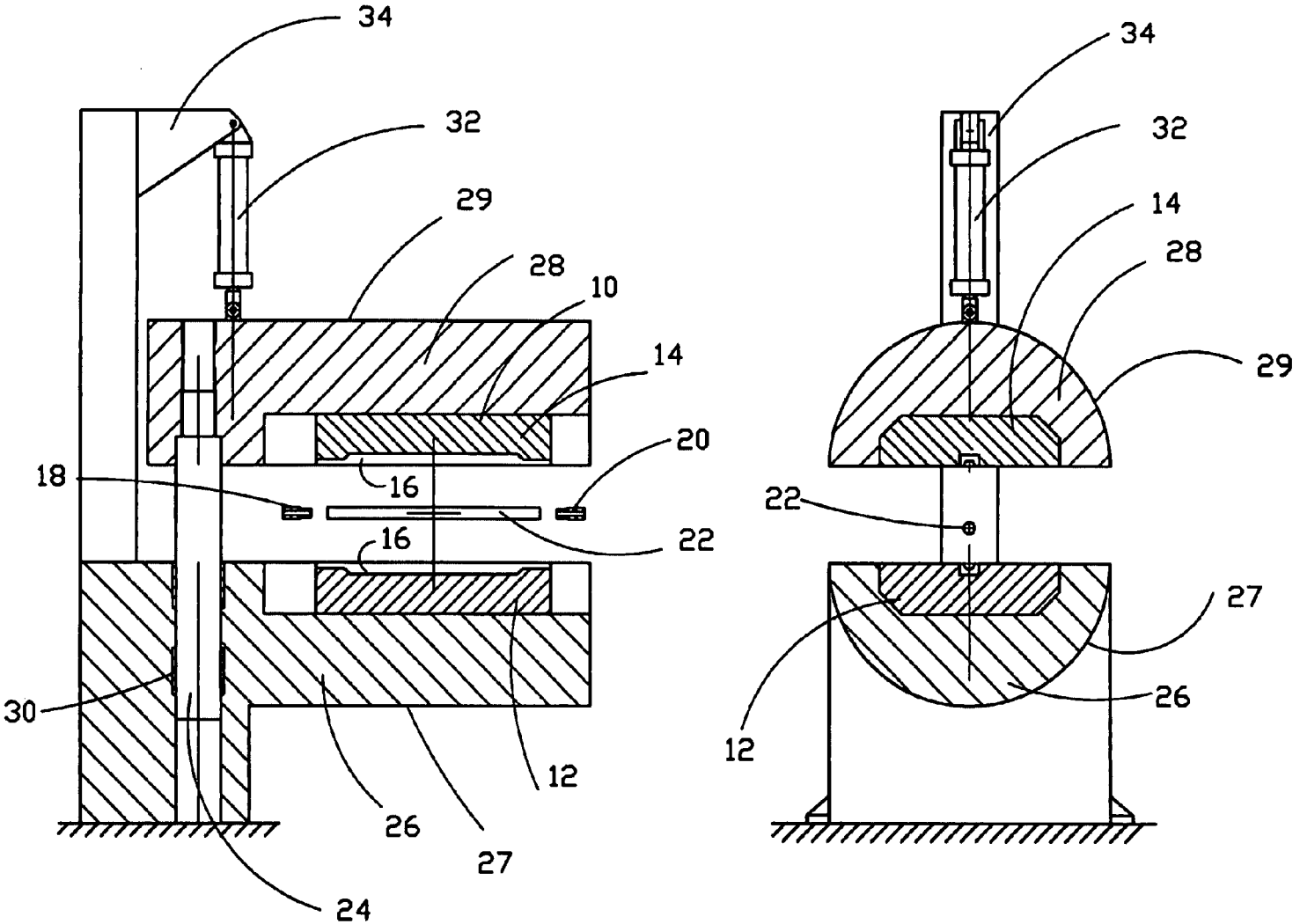
FIG. 4*a* is a sectional view of the hydroforming apparatus according to the invention without the outer ring showing the hydroforming die in the open position, drawn at a larger scale.
FIG. 4*b* is another sectional view of the hydroforming apparatus of FIG. 4*a;*
Figure 4B:
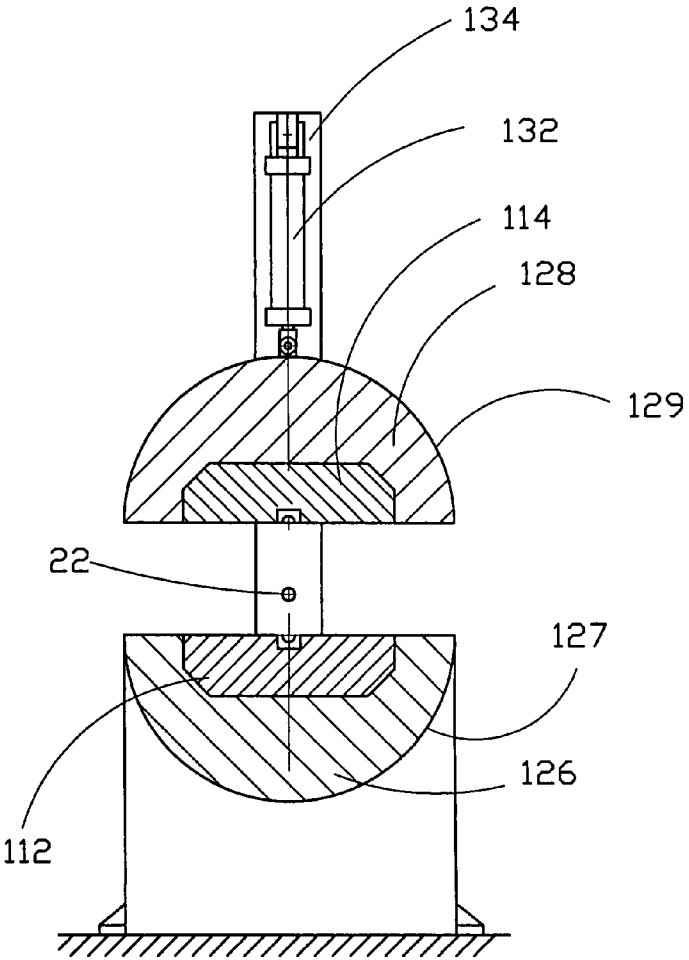
Figure 4A:
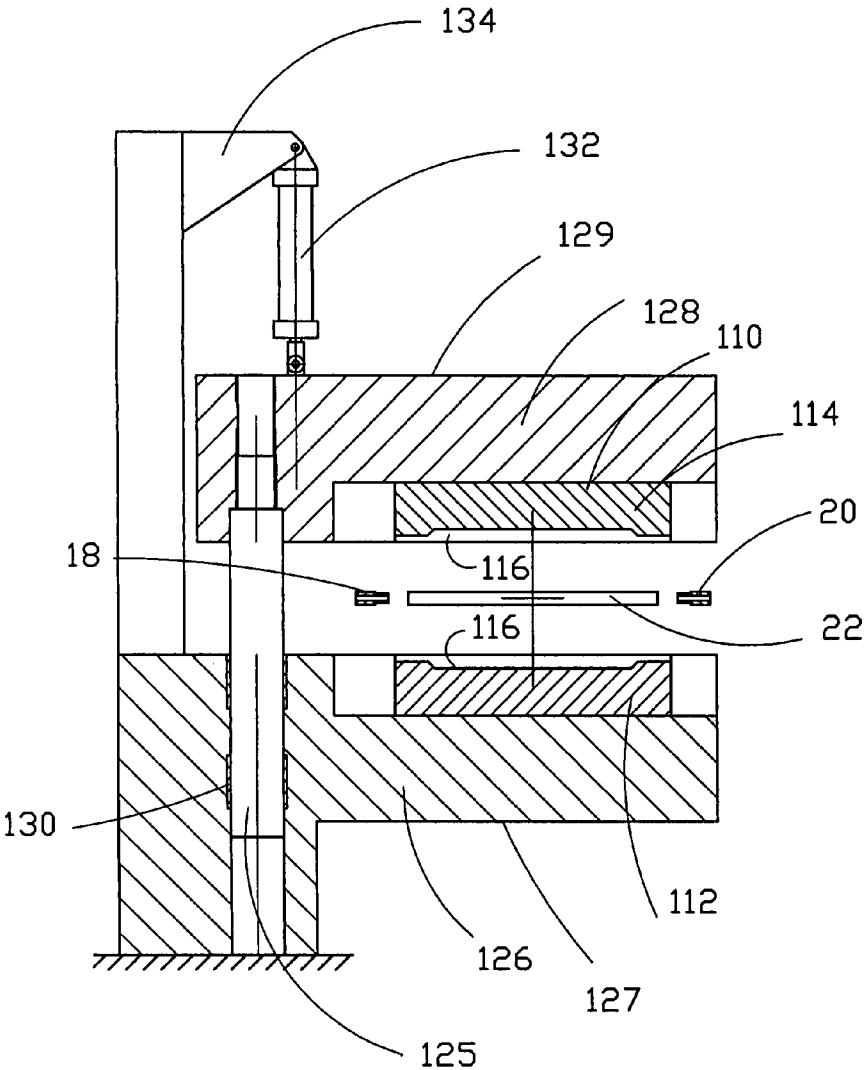
Figure 5:
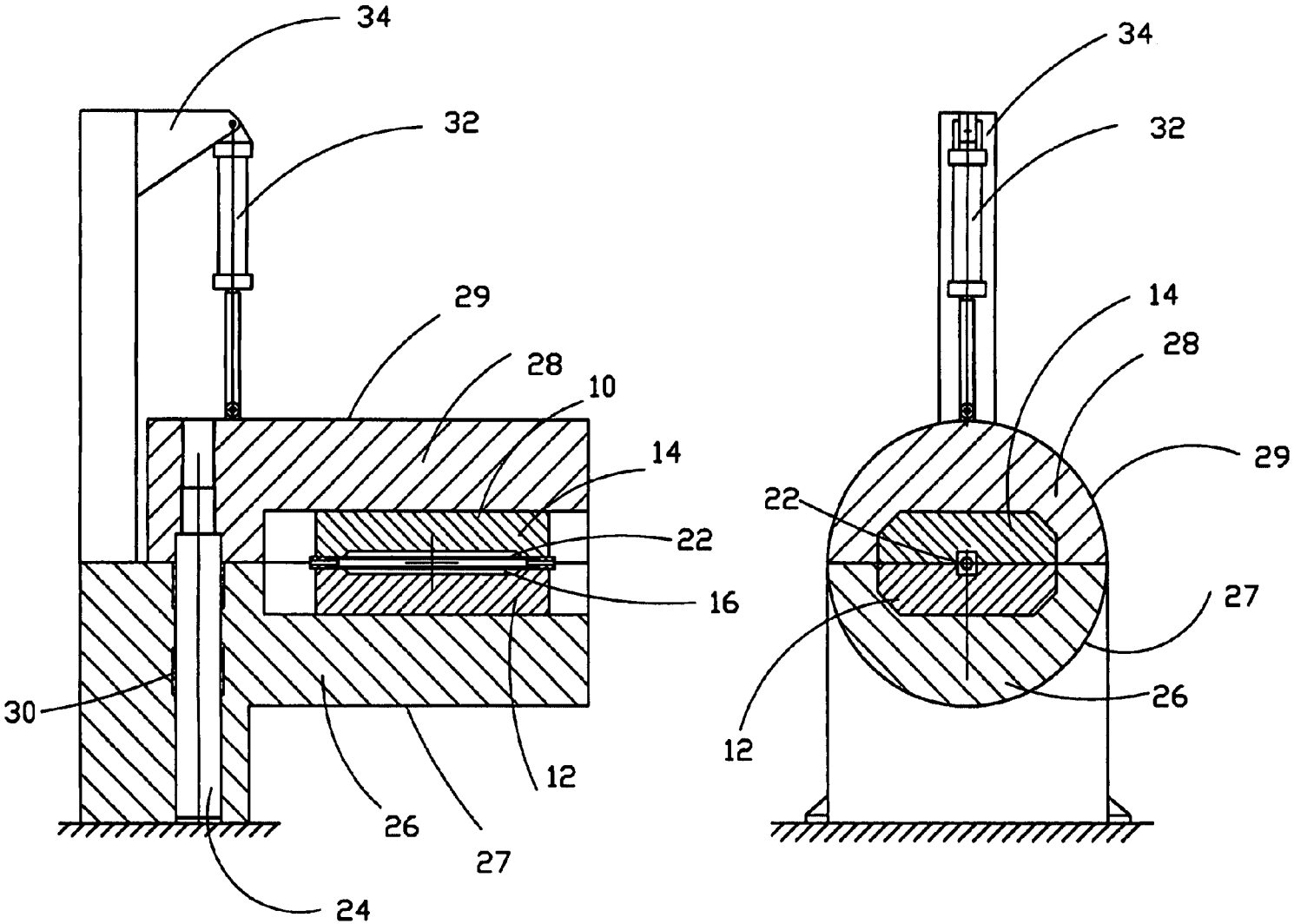
FIG. 5*a* is a sectional view of the hydroforming apparatus according to the invention without the outer ring showing the hydroforming die in the closed position.
FIG. 5*b* is another sectional view of the hydroforming apparatus of FIG. 5*a;*
Figure 5B:
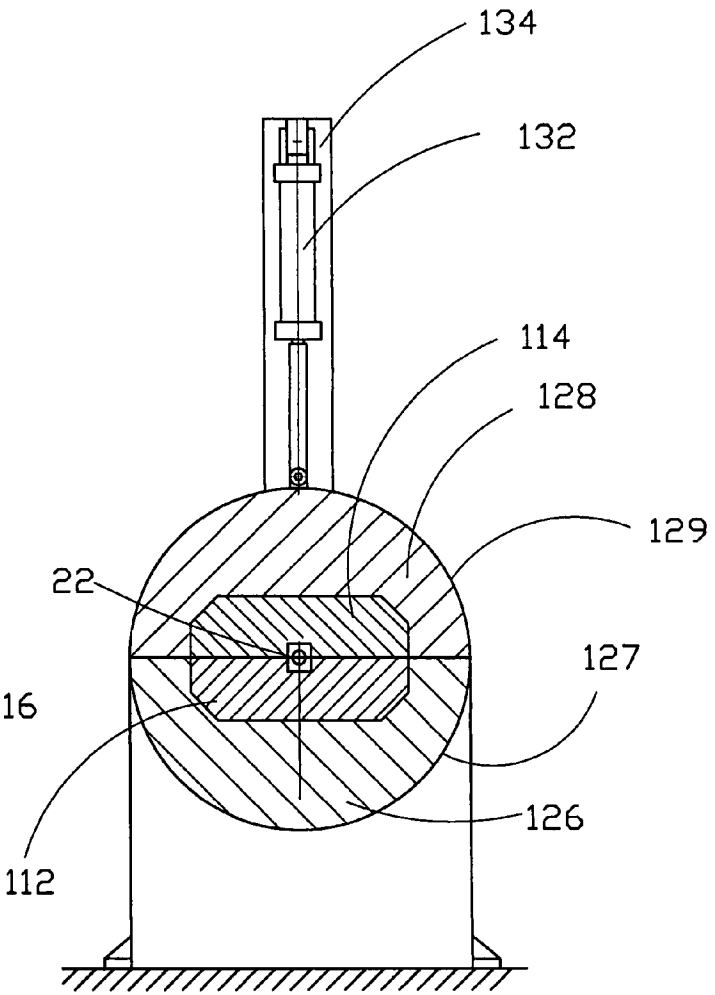
Figure 5A:
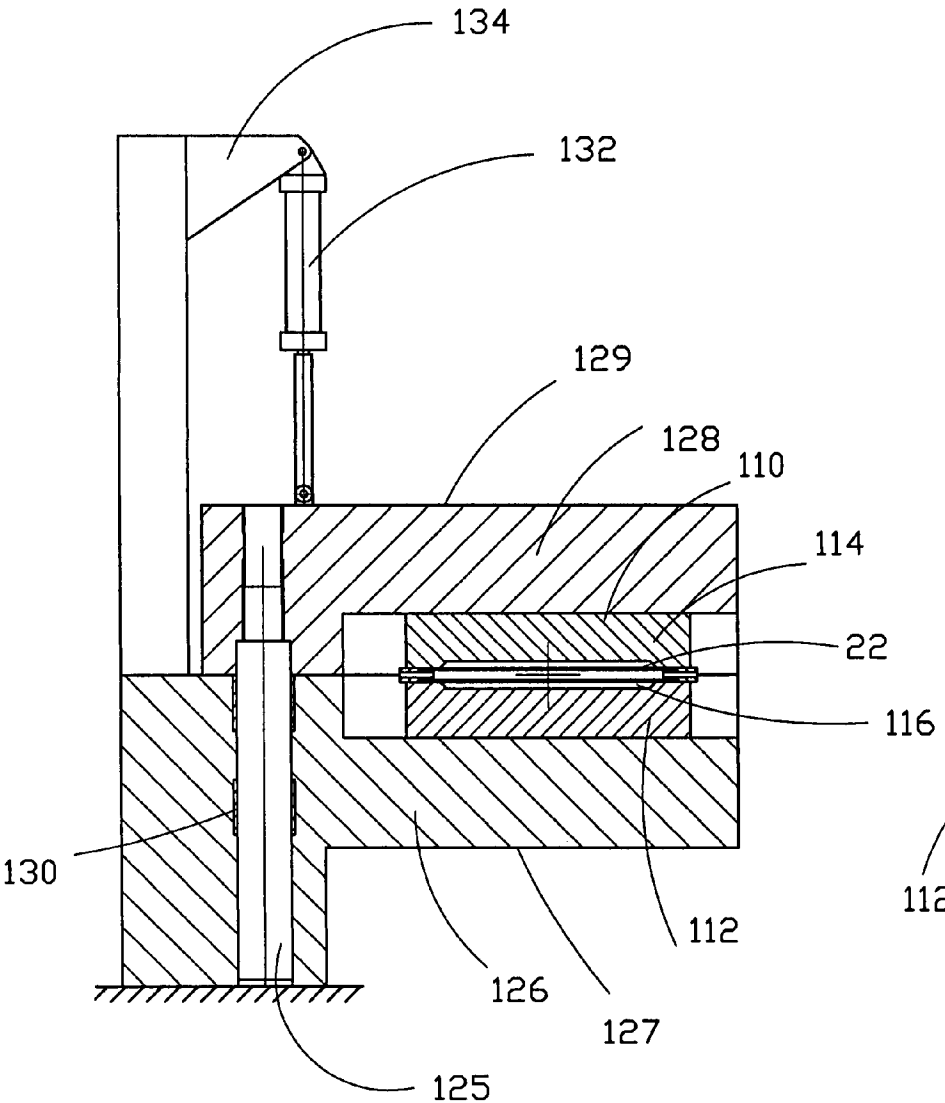

As shown in FIGS. 1, 4*a*, 4*b*, 5*a*, and 5*b*, in one embodiment, the hydroforming apparatus 108 according to the current invention includes a die 110 having a lower die section 112 and an upper die section 114. The lower and upper die sections 112, 114 preferably combine to define a die cavity 116. The lower die section 112 is mounted in a lower die holder 126 and the upper die section 114 is mounted in an upper die holder 128. The lower die 112 and the lower die holder 126 preferably are fixed and the upper die 114 and the upper die holder 128 are movable up and down between an open position (as shown in FIGS. 4*a* and 4*b*) and a closed position (as shown in FIGS. 5*a* and 5*b*).

The upper die holder 128 is guided to and from the lower die holder 126 by using guide rods 125 and guide bushings 130 or by any other means that are obvious to those who are skilled in the art. Furthermore, the upper die holder 128 is moved up and down using a hydraulic cylinder 132 mounted to a frame 134 or by any other suitable means as would be known by those skilled in the art.

Furthermore an outer surface 127 of the lower die holder 126 is provided with a half-cylindrical shape and an outer surface 129 of the upper die holder 128 is provided with a half-cylindrical shape so that when the upper die holder 128 is moved to the closed position, the outer surface 127 of the lower die holder 126 and the outer surface 129 of the upper die holder 128 combine to form a cylindrical shape (FIGS. 5*a*, 5*b*).

Figure 6:
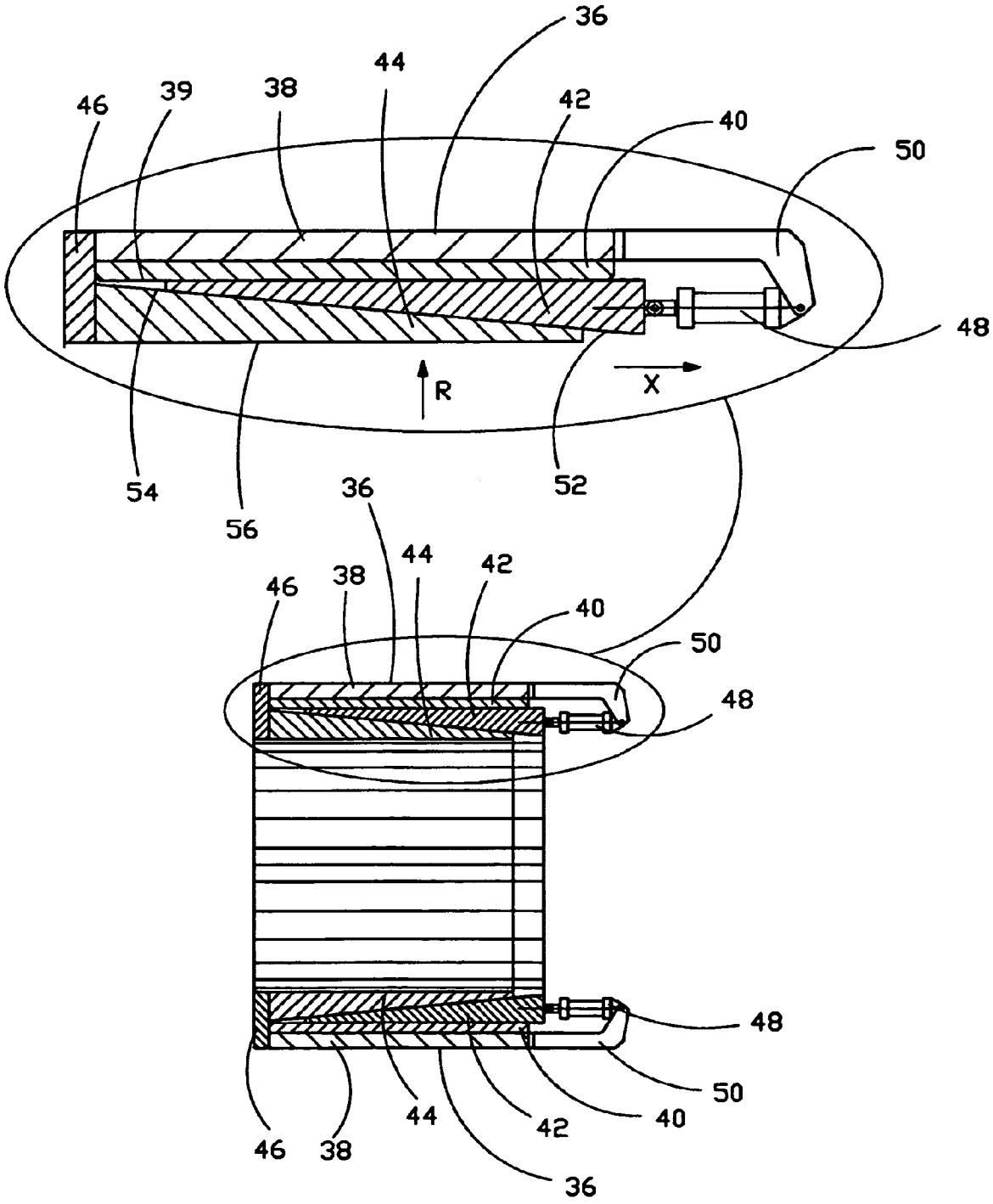
FIG. 6*a* is a sectional view of an embodiment of the outer ring of the invention with tapered wedges thereof each in a retracted position and lower cam segments each in an open position.
FIG. 6*b* is a sectional view showing an upper tapered wedge and cam segment, drawn at a larger scale.
FIG. 6*c* is a sectional view of the tapered wedge, drawn at a larger scale.
FIG. 6*d* is a sectional view of the lower cam segment, drawn at a smaller scale.
Figure 6B:
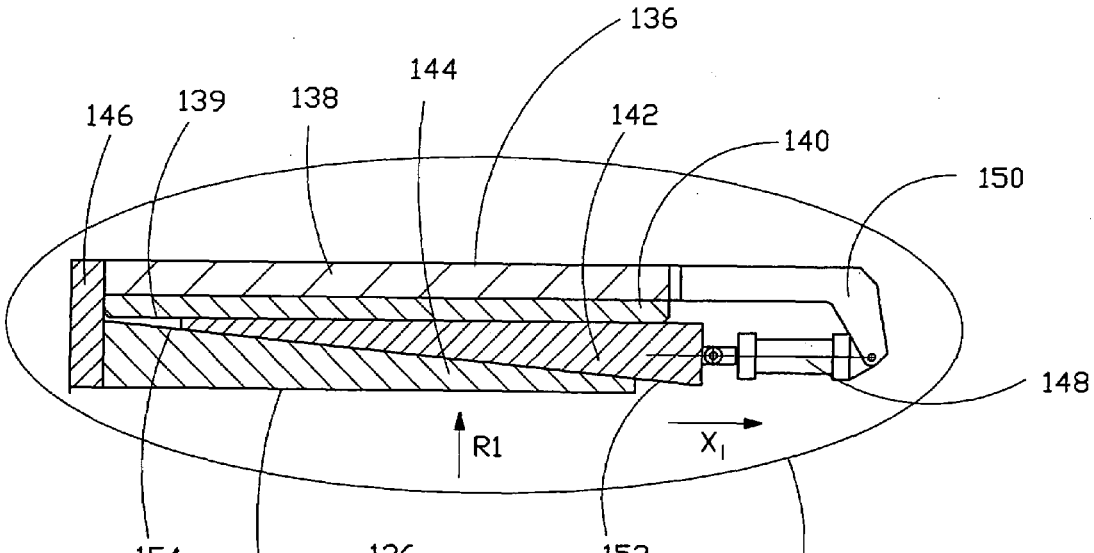
Figure 6A:
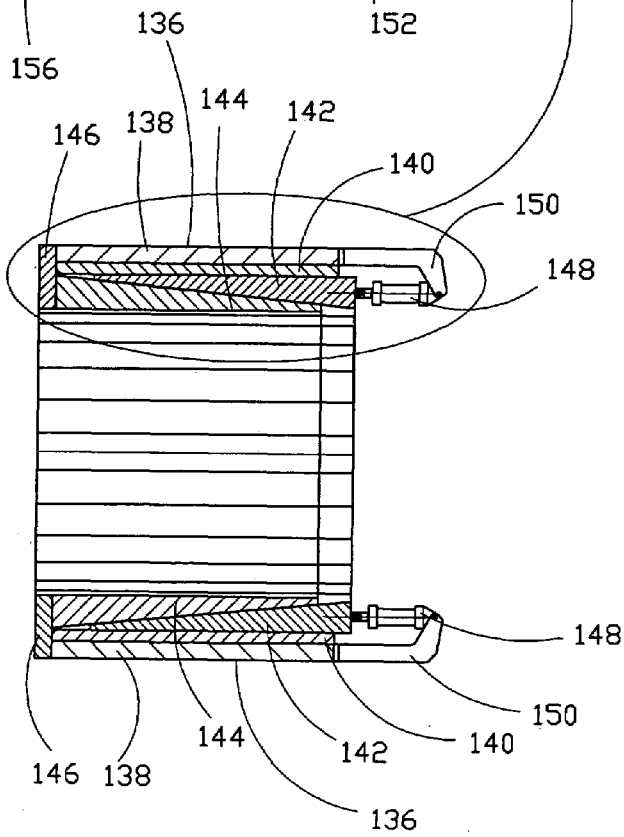
Figure 6C:
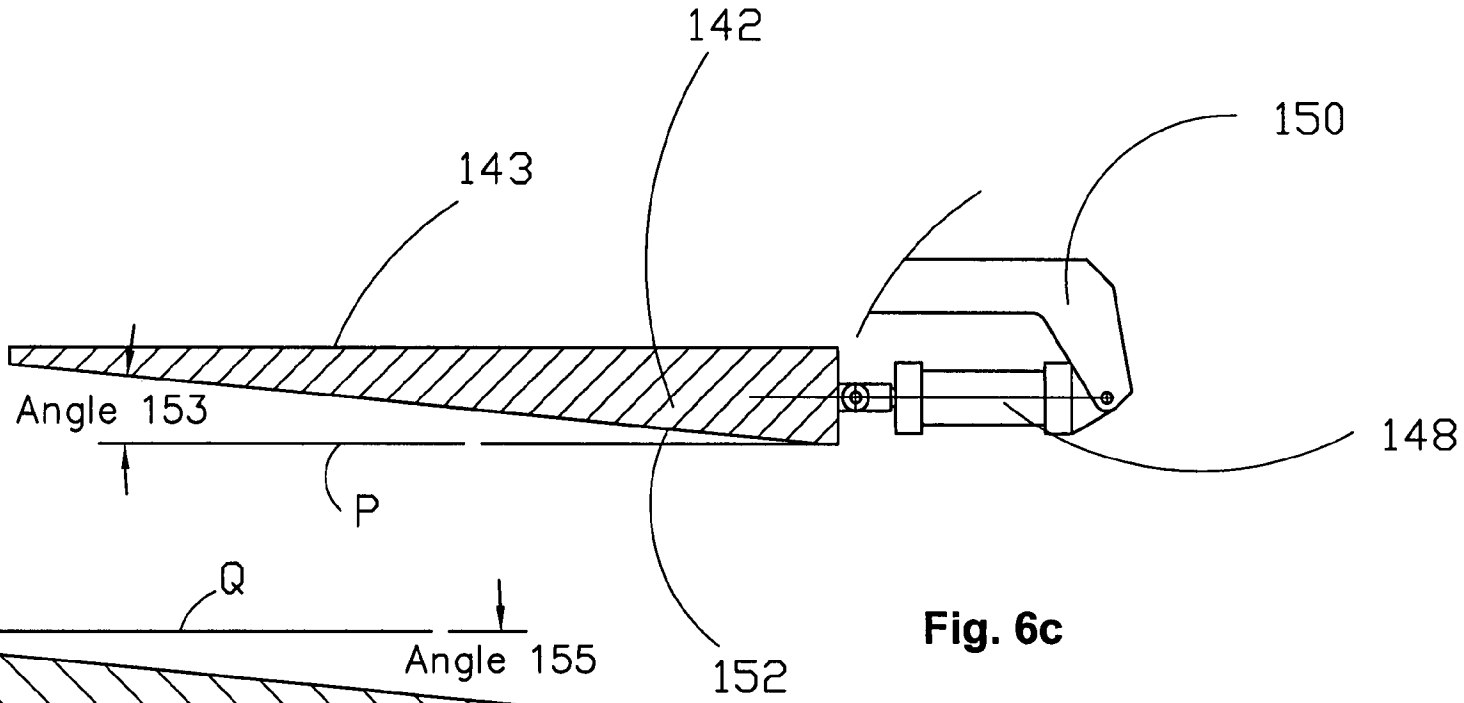
Figure 6D:
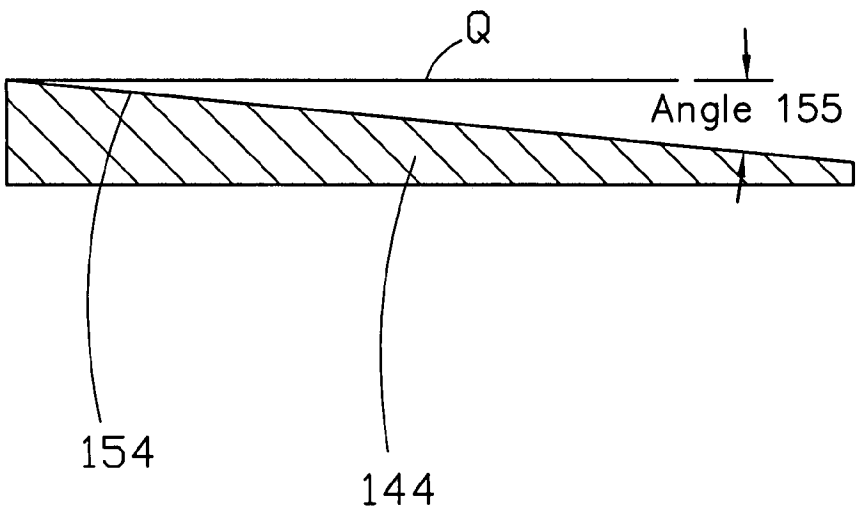
Figure 7:
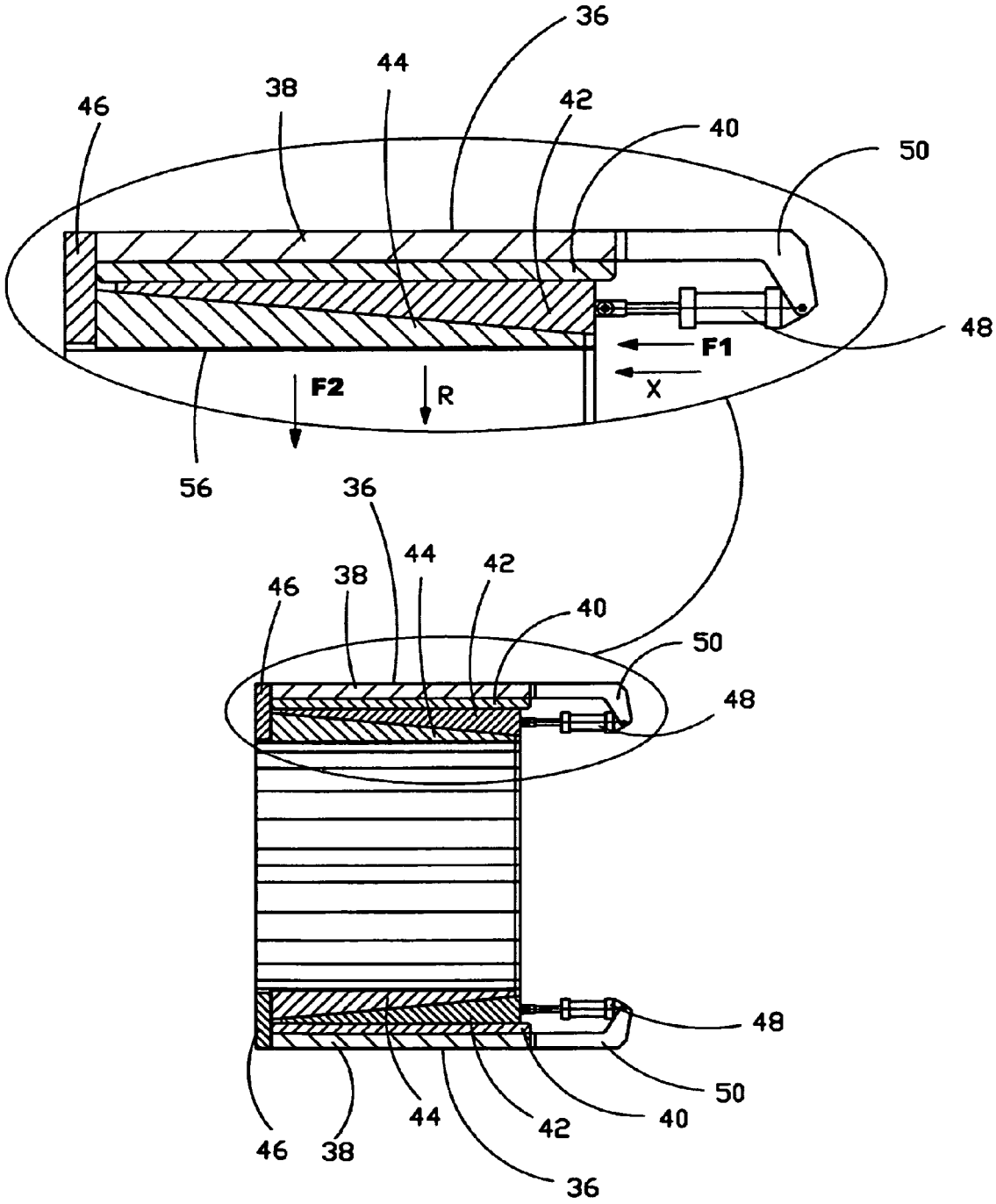
FIG. 7*a* is a sectional view of the outer ring of FIG. 6*a* with tapered wedges thereof each in an extended position and lower cam segments each in a closed position.
FIG. 7*b* is a sectional view showing an upper tapered wedge and cam segment, drawn at a larger scale.
Figure 7B:
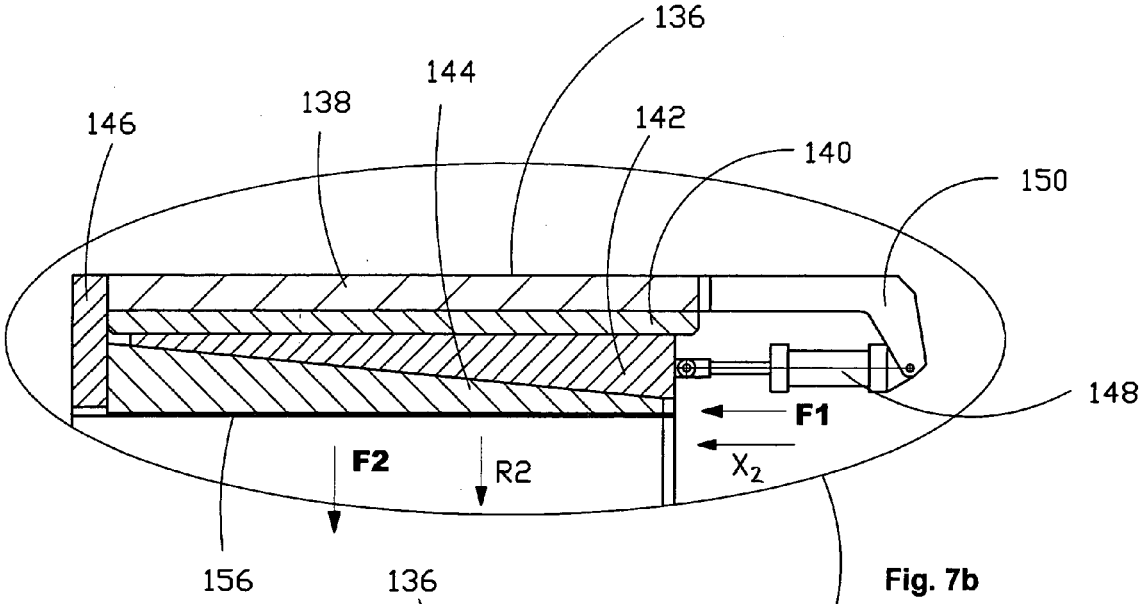
Figure 7A:
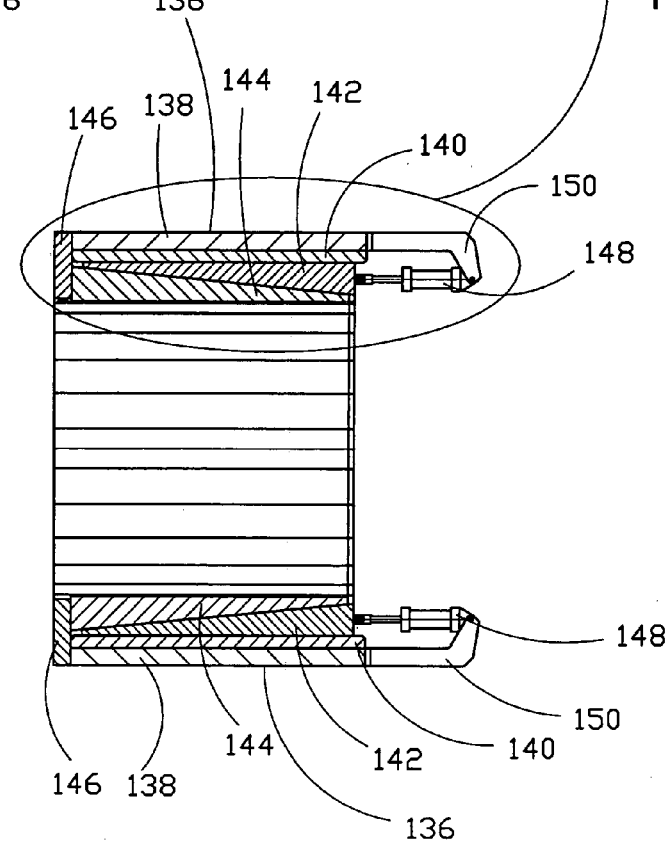
Figure 8:
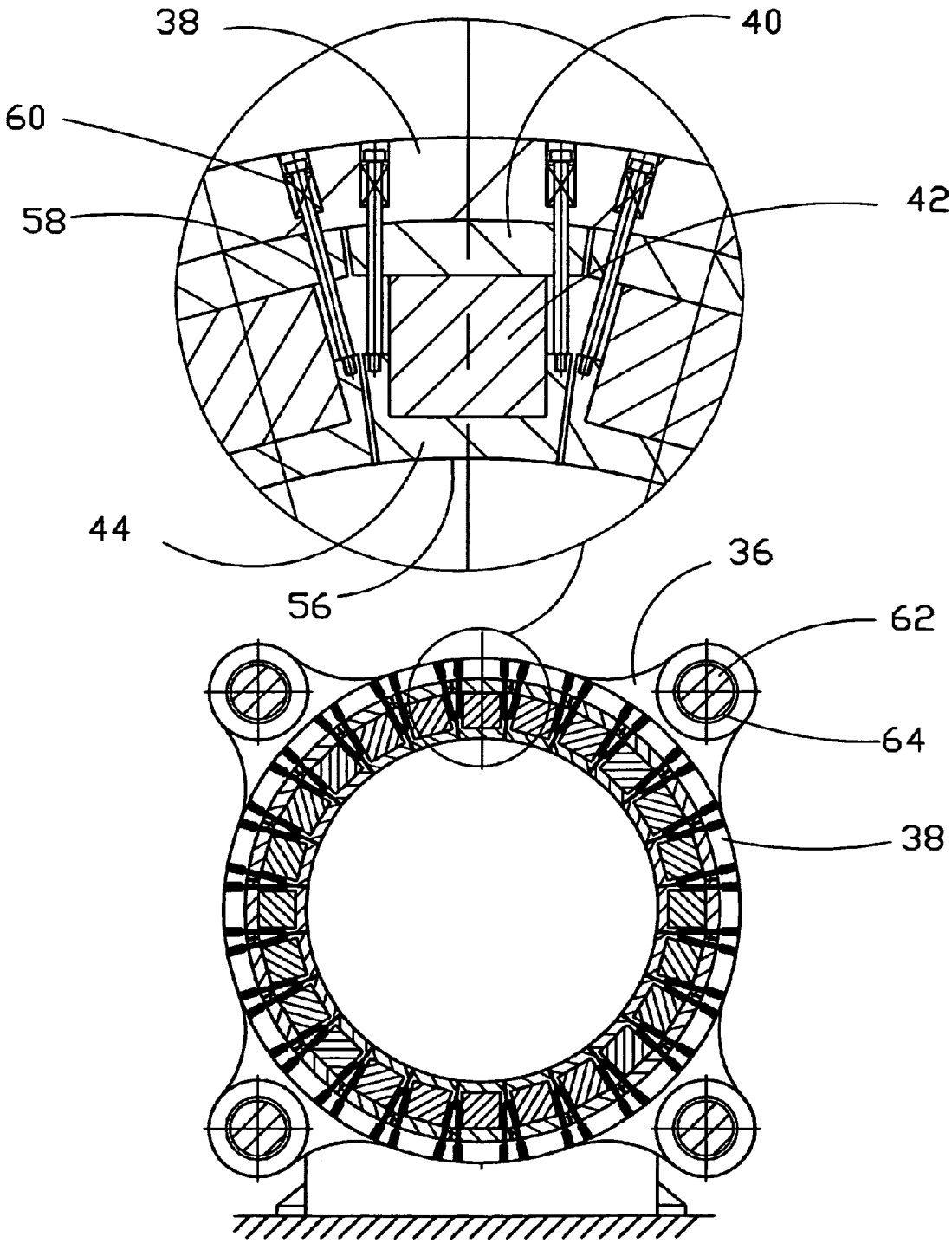
FIG. 8*a* is a cross sectional view of the outer ring of FIG. 6*a*, drawn at a smaller scale.
FIG. 8*b* is a cross-sectional view of a portion of the outer ring of FIG. 8*a*, drawn at a larger scale.

As can be seen in FIGS. 6*a*, 6*b*, 6*c*, 6*d*, 7*a*, 7*b*, 8*a*, and 8*b*, the current invention includes an outer ring subassembly 136 including a ring 138, a first cam segment 140, a tapered wedge 142, and a second cam segment 144. The first cam segment 140 is attached to an inner surface 139 of the ring 138 and the second cam segment 144 is attached to the ring 138 using bolts 58 and springs 60 (FIG. 8). The second cam segment 144 is allowed to travel in the directions of arrows $R_1$, $R_2$ (FIGS. 6*b*, 7*b*) between an open position (FIGS. 6*a*, 6*b*) and a closed position (FIGS. 7*a*, 7*b*).

The tapered wedge 142 is placed between the first cam segment 140 and the second cam segment 144 and is moved by a cylinder 148. The tapered wedge 142 is allowed to move in the directions of arrows $X_1$, $X_2$ (FIGS. 6*b*, 7*b*) between a retracted position (FIGS. 6*a*, 6*b*) and an extended position (FIGS. 7*a*, 7*b*). The cylinder 148 is attached to the ring 138 by a mounting bracket 150. Each tapered wedge 142 has a substantially planar surface 143.

A contact surface 152 of the tapered wedge 142 is positioned at a small angle 153 relative to a plane ("P" in FIG. 6*c*) parallel to the planar surface 143 that is less than 45 degrees. Also, the second cam segment 144 has a substantially planar surface 145. A mating surface 154 of the second cam segment 144 is positioned at a small angle 155 relative to a plane ("Q" in FIG. 6*d*) parallel to the mating surface 154. Preferably, the angle 155 is the same as the small angle 153 (as illustrated in FIG. 6*c*) so that when the tapered wedge 142 is in the retracted position, the second cam segment 140 is moved by the spring 160 (FIG. 8*b*) to the open position as shown in FIG. 6*b*. Also, as the tapered wedge 142 is moved to the extended position, the second cam segment 140 is moved to the closed position as shown in FIGS. 7*a*, and 7*b*.

The cylinder 148 exerts force F1 on the said tapered wedge 142 (FIG. 7*b*). The contact surface 152 of the tapered wedge 142 is in contact with the mating surface 154 of the second cam segment 144 so that the force F1 that is exerted on the tapered wedge 142 results in a force F2 that is exerted on the second cam segment 144 in a direction perpendicular to the said force F1 (FIG. 7*b*). Because the angles 153 and 155 are each less than 45 degrees, the force F2 is greater than the force F1. In practice and according to this invention, the angles 153 and 154 provide a slope having a ratio between 5:1 to 20:1 (i.e., relative to the planar surfaces 143, 145 respectively) so that the force F2 is greater than the said force F1 by a ratio of between about 5 times and about 20 times respectively.

Figure 8B:
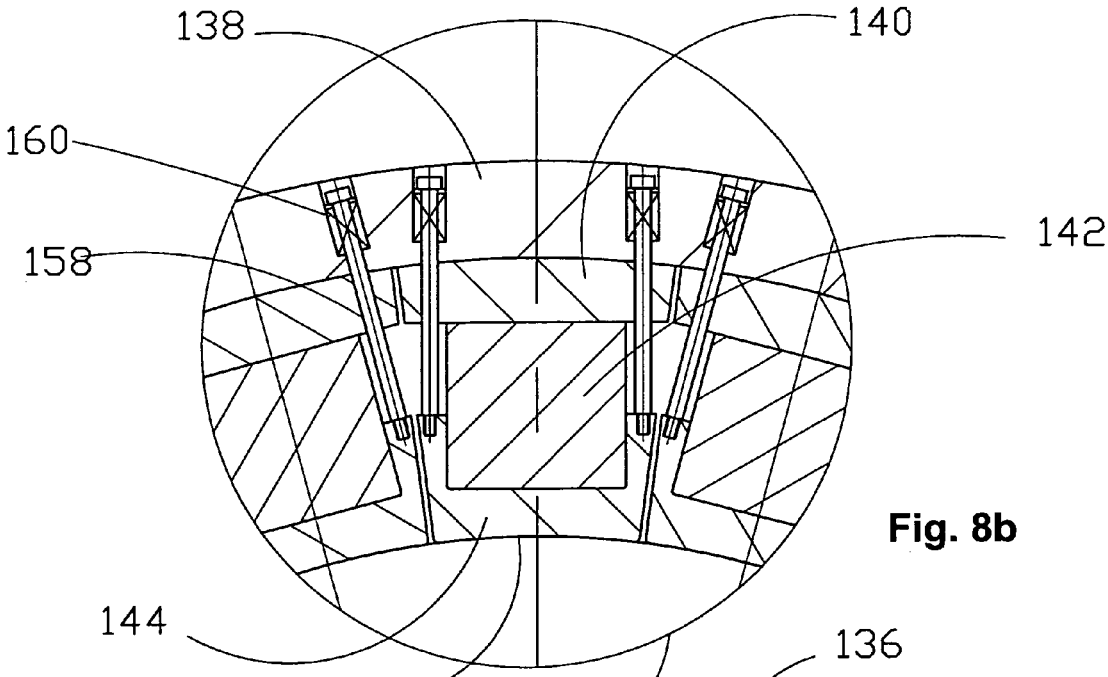

With reference to FIG. 8*b*, a lower surface 156 of the second cam segment 144 is curved with the same cylindrical radius as the outer surfaces 127 and 129 of the lower die holder 126 and the upper die holder 128.

Figure 8A:
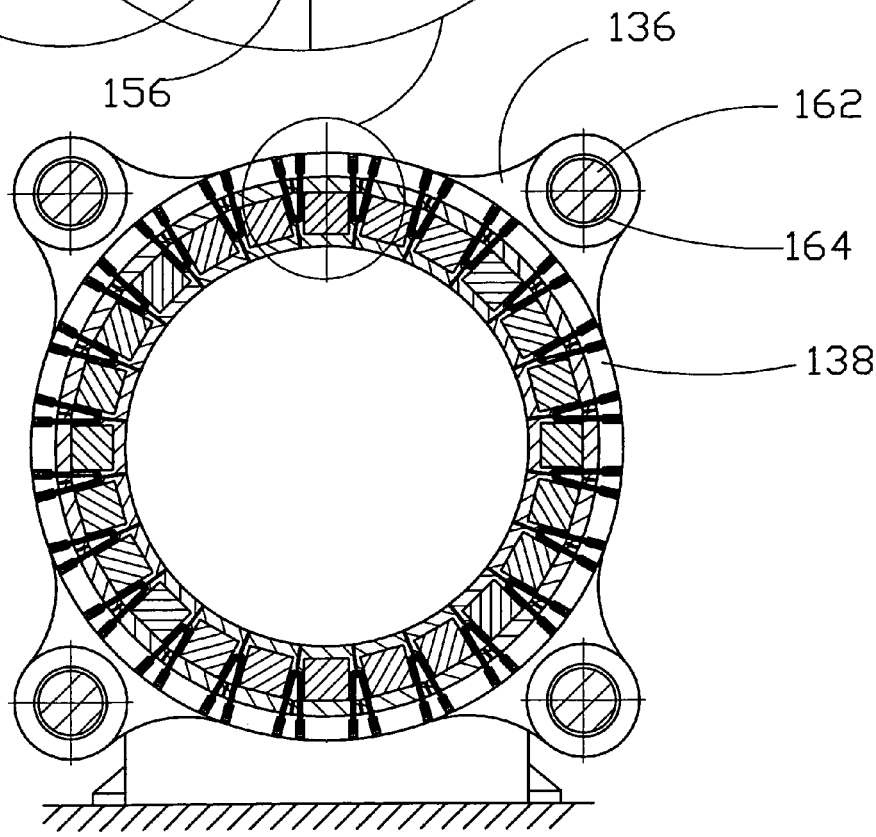

With reference to FIG. 8*b*, the first cam segment 140, the tapered wedge 142, and the second cam segment 144 preferably are equal in number to each other. FIG. 8*a* shows 24 first cam segments 140, the tapered wedges 142, and second cam segments 144.

Figure 9:
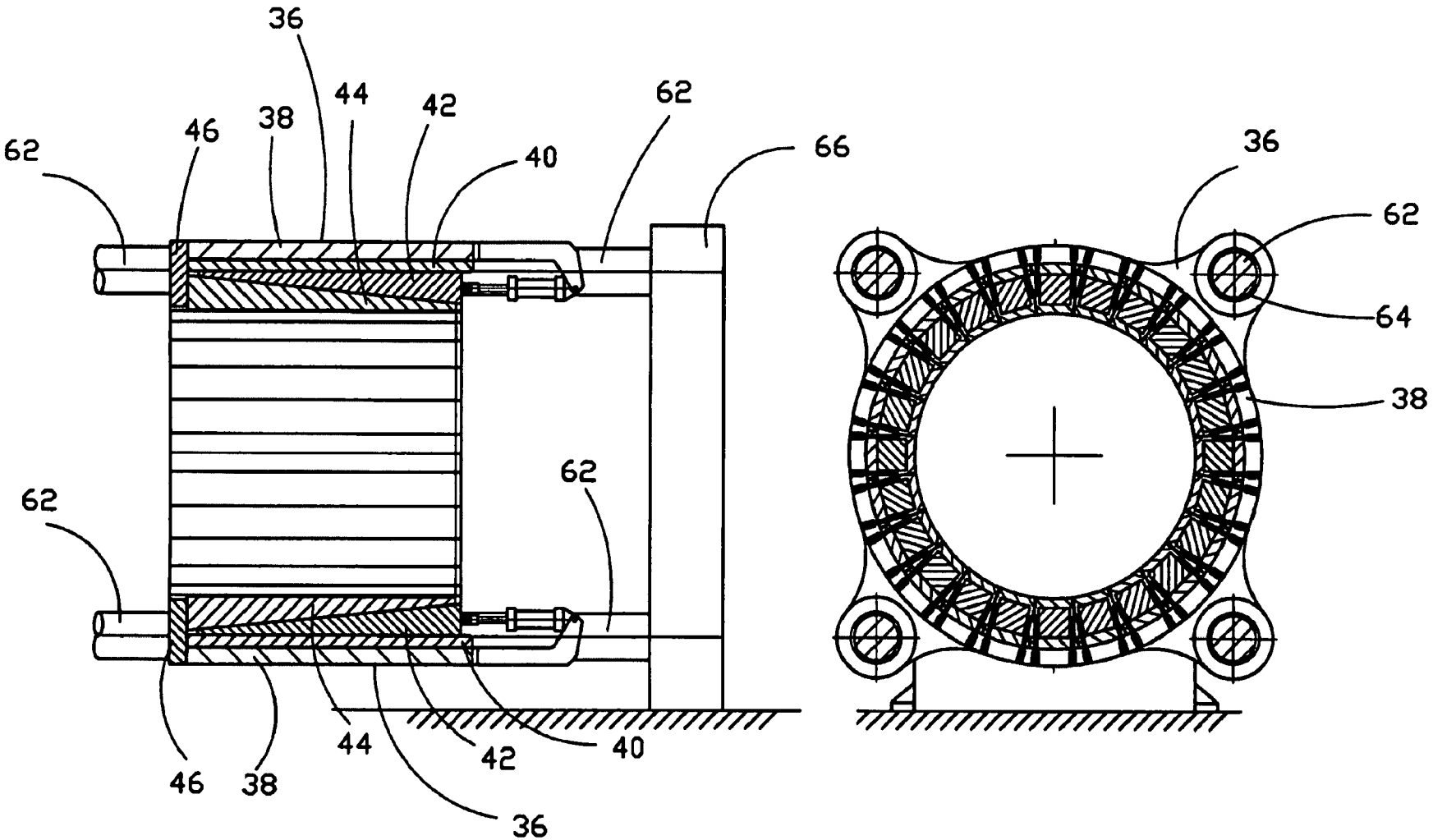
FIG. 9*a* is a sectional view of the outer ring of FIG. 6*a* showing guide rods and bushings.
FIG. 9*b* is a sectional view of the outer ring of FIG. 6*a*, drawn at a smaller scale.
Figures 9A, 9B:
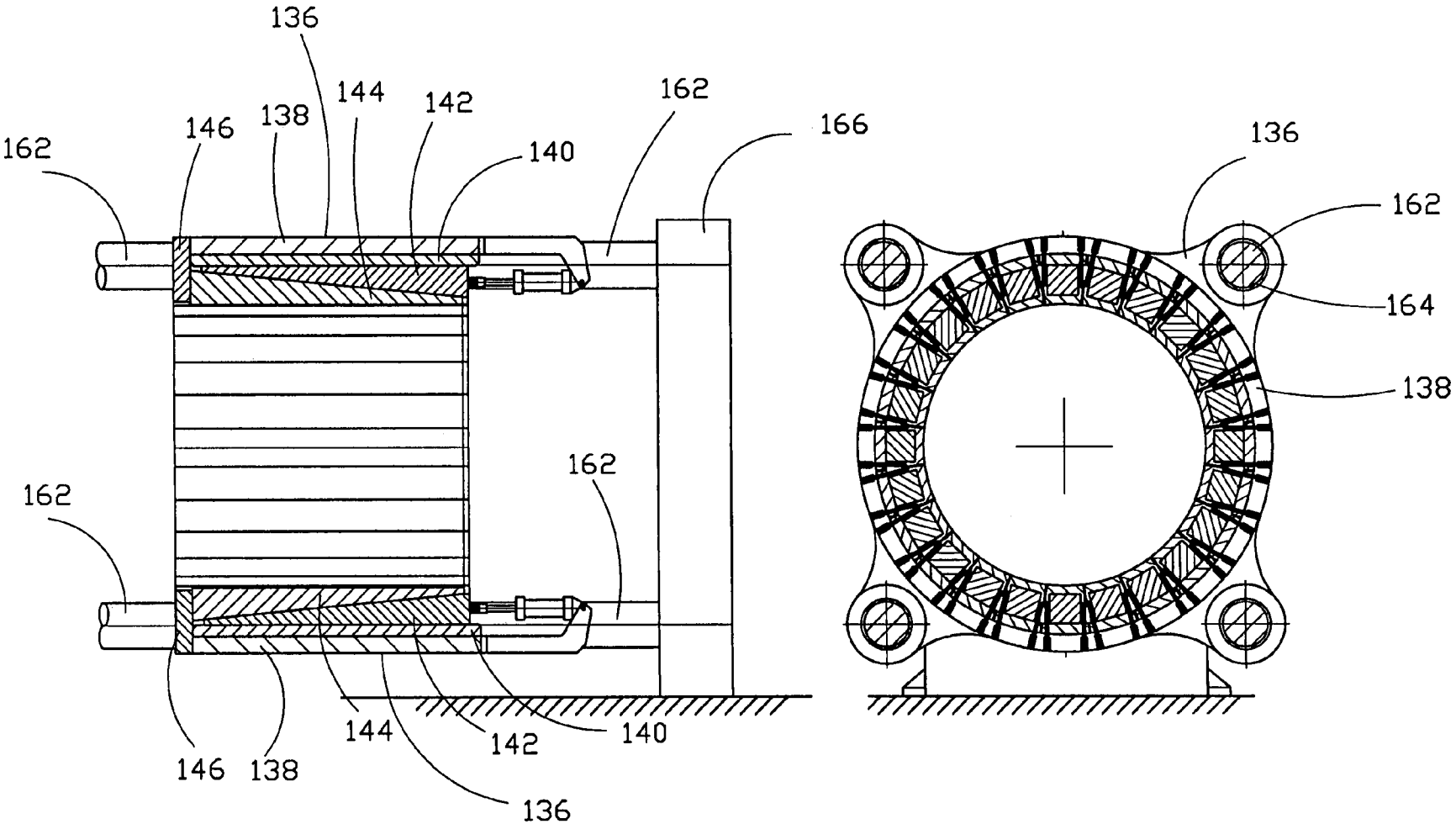
Figure 10:
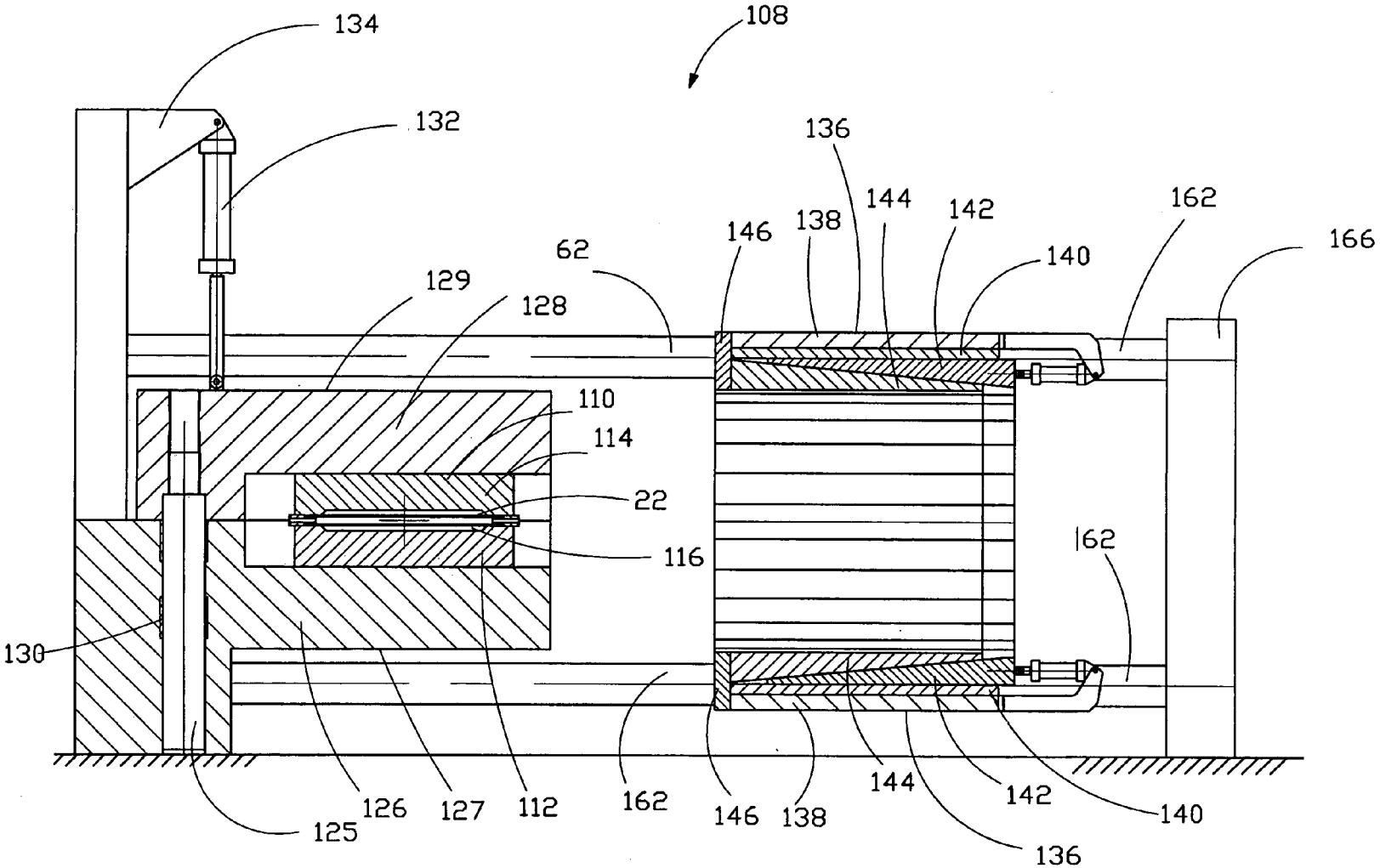
FIG. 10 is a sectional view of the die and die holder and outer ring of FIG. 6*a* with the die closed and the outer ring in the returned position, drawn at a smaller scale.
Figure 11:
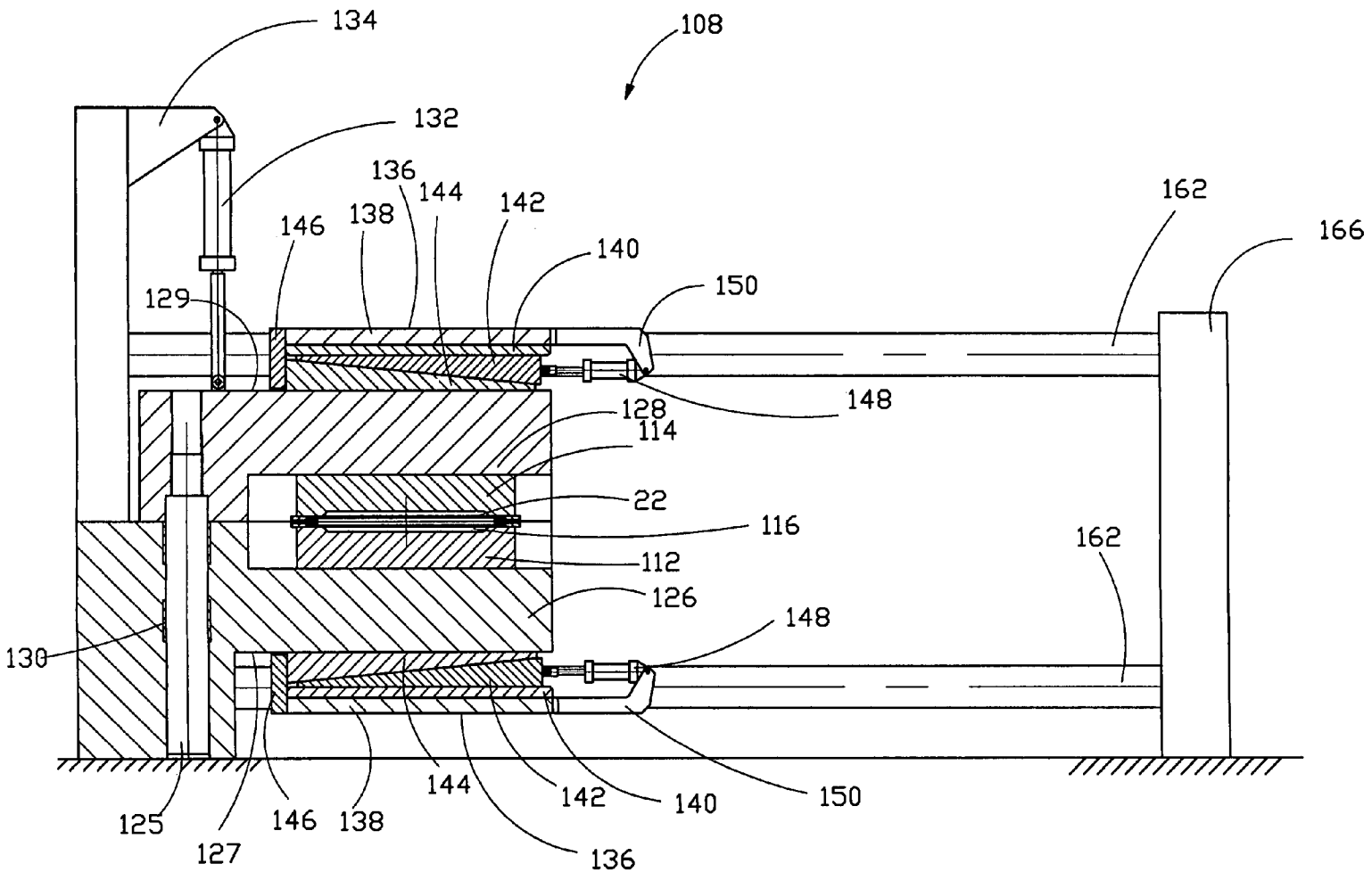
FIG. 11 is a sectional view showing the outer ring of FIG. 6*a* in the forward position.

With reference to FIGS. 9*a* and 9*b*, the outer ring subassembly 136 is guided by guide rods 162 and guide bushings 164 so that the outer ring subassembly 136 can be moved horizontally between a forward position (FIGS. 1, 11) and a returned position (FIG. 10). The movement of the outer ring subsequently 136 can be by a cylinder or a motor and gear and rack or any other suitable means as is known by those who are skilled in the art. The means of guiding the outer ring subassembly 136 can be as described using the guide rods 162 and the guide bushings 164 or by any other suitable means.

FIG. 10 shows the upper die holder 128 and the upper die section 114 in the closed position, with the tube 22 in the cavity 116. The side plugs 18 and 20 are positioned to seal both ends of the tube 22. The outer ring subassembly 136 is in the returned position and the tapered wedges 142 are in the retracted position (FIG. 10) allowing the second cam segments 144 to move to the open position (FIG. 10). The outer ring subassembly 136 is moved horizontally to the forward position (FIGS. 1, 11) so that the lower die holder 126 and the upper die holder 128 are contained inside the second cam segments 144. Next, the cylinders 148 are extended, moving the tapered wedges 142 to the extended position and the second cam segments 144 to the closed position. The curved lower surfaces 156 of the lower cam segments 144 contact the curved outer surface 127 of the lower die holder 126 and the curved outer surface 129 of the upper die holder 128. The cylinders 148 exert the force F1 (FIG. 7*b*) on the tapered wedges 142 and the tapered wedges 142 consequently exert the force F2 (FIG. 7*b*) on the second cam segments 144. Since the second cam segments 144 are in contact with the lower die holder 126 and the upper die holder 128, the force F2 is transmitted to the lower and upper die holders 126 and 128. The force F2 keeps the lower and upper die holders 126 and 128 closed and keeps the lower die section 112 and the upper die section 114 closed during the hydroforming operation.

Figure 12:
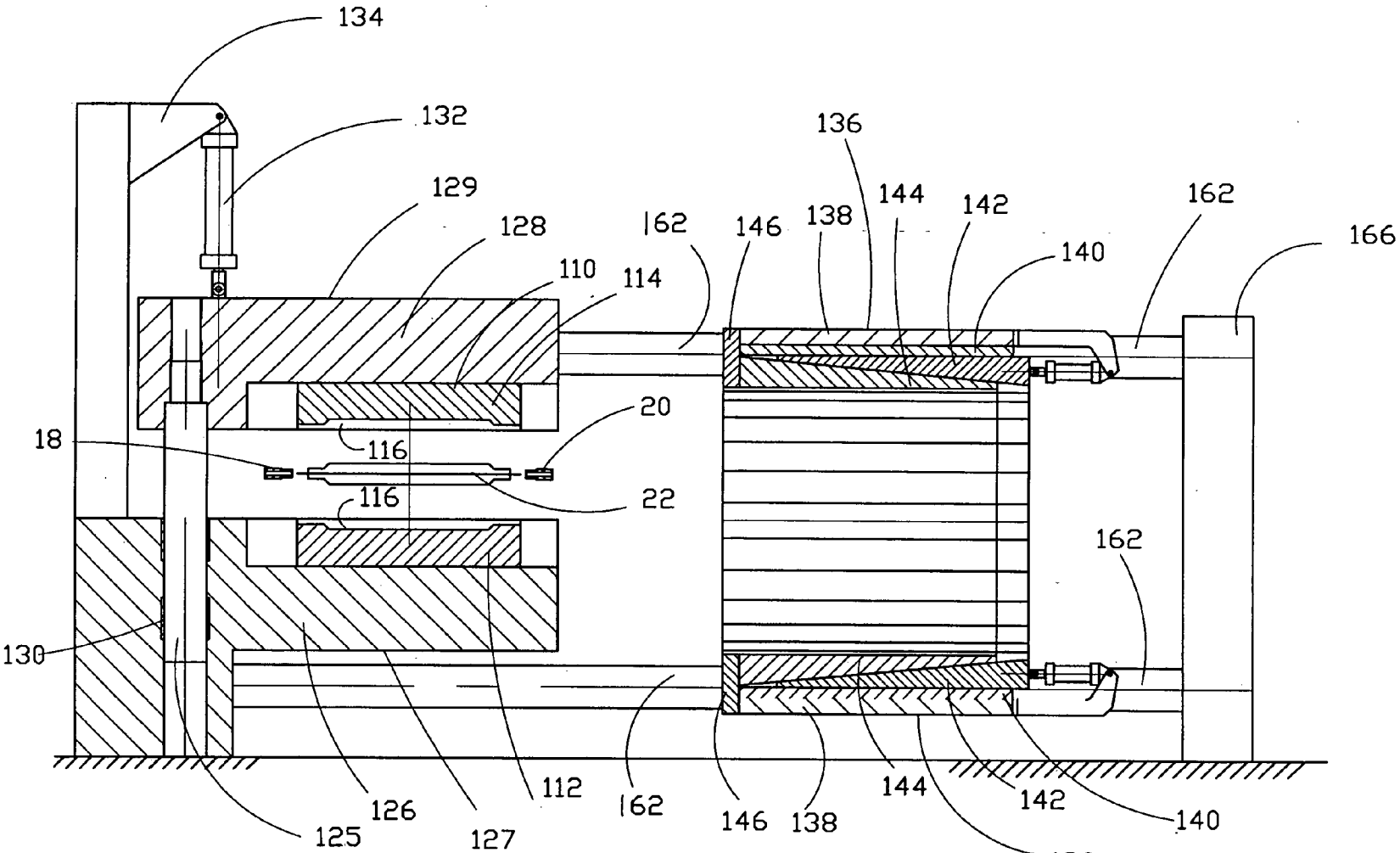
FIG. 12 is a sectional view showing the outer ring in the returned position and the die holder in the open position after hydroforming is complete.

Next, a hydraulic pressure source (not shown) is connected to the interior of the tube 22 through the opening 124 inside the plugs 118 and 120 to provide fluid under pressure which expands the tube 22 until the tube 22 conforms to the shape of the die cavity 116, as is known in the art. Then, the hydraulic pressure source is disconnected and the cylinders 148 are retracted, moving the tapered wedges 142 to the retracted position and the second cam segments 144 to the open position (FIGS. 6*a*, 6*b*). This allows the outer ring subassembly 136 to move horizontally to the returned position (FIG. 10). After the outer ring subassembly 136 has been moved to the returned position, the upper die holder 128 and the upper die segment 114 are moved to the open position, allowing the removal of the tube 22 as illustrated in FIG. 12.

Since the force F2 is greater than the force F1, the force require to keep the die 110 closed during the hydroforming operation of the invention is smaller than would be needed in a prior art hydroforming apparatus.

Also, since the force F2 required to keep the die 110 closed is contained within the outer ring subassembly 138 (which has a cylindrical shape, known to be efficient in load carrying), the structure of the apparatus of the invention is smaller and lighter than that of the prior art.

Additional embodiments of the invention are shown in FIGS. 13*a*, 13*b*, 14, 15*a*, 15*b*, 16, 17, 18*a*, and 18*b*. In FIGS. 13*a*, 13*b*, 14, 15*a*, 15*b*, 16, 17, 18*a*, and 18*b*, elements are numbered so as to correspond to like elements shown in FIGS. 1, 4*a*, 4*b*, 5*a*, 5*b*, 6*a*, 6*b*, 6*c*, 6*d*, 7*a*, 7*b*, 8*a*, 8*b*, 9*a*, 9*b*, 10, 11, and 12.

Figure 18:
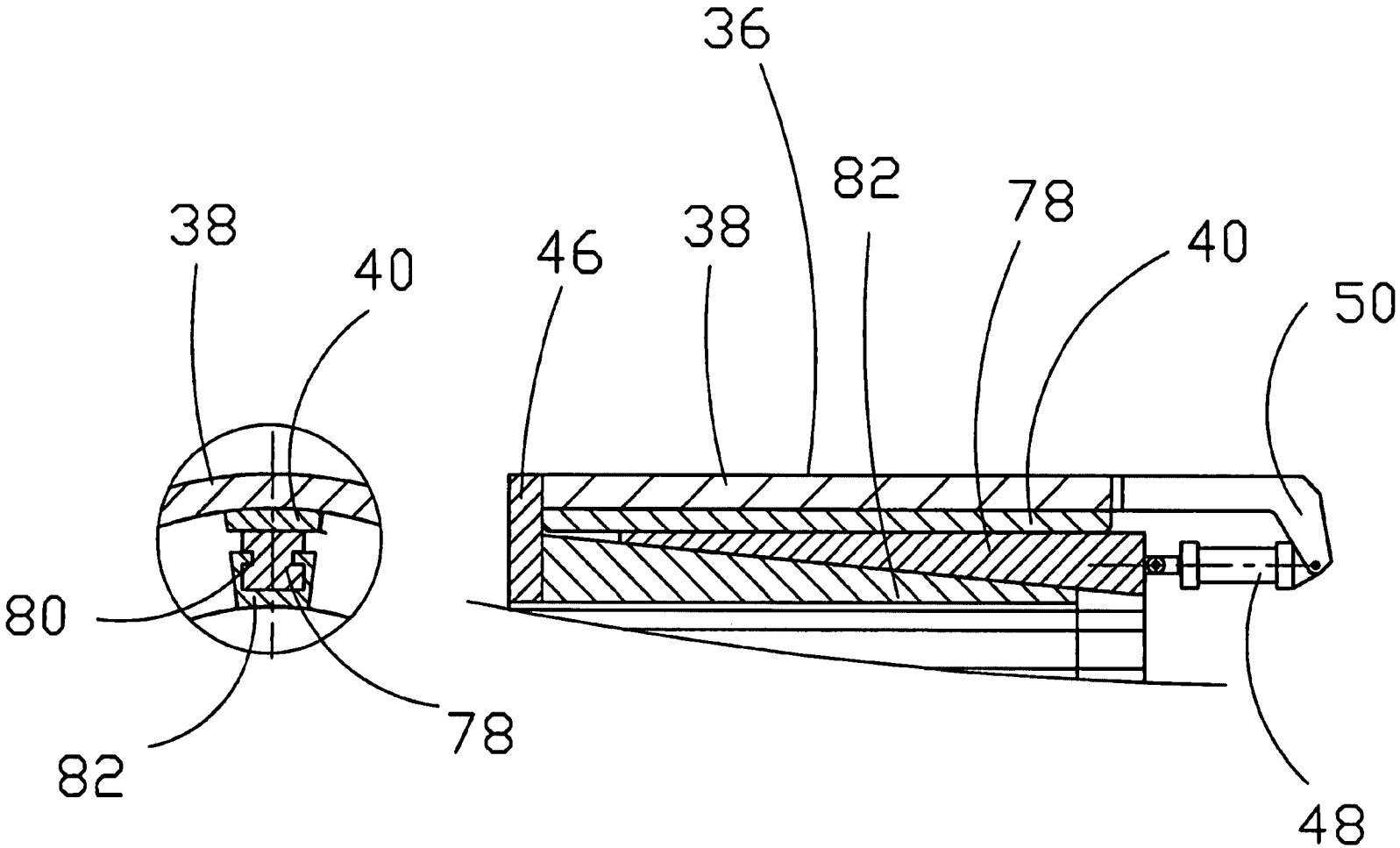
FIG. 18*a* shows an alternative embodiment of the invention, including a double tapered wedge and lower cam segment.
FIG. 18*b* is a sectional view of an upper tapered wedge and cam segment of the invention illustrated in FIG. 18*a*.
Figure 18B:
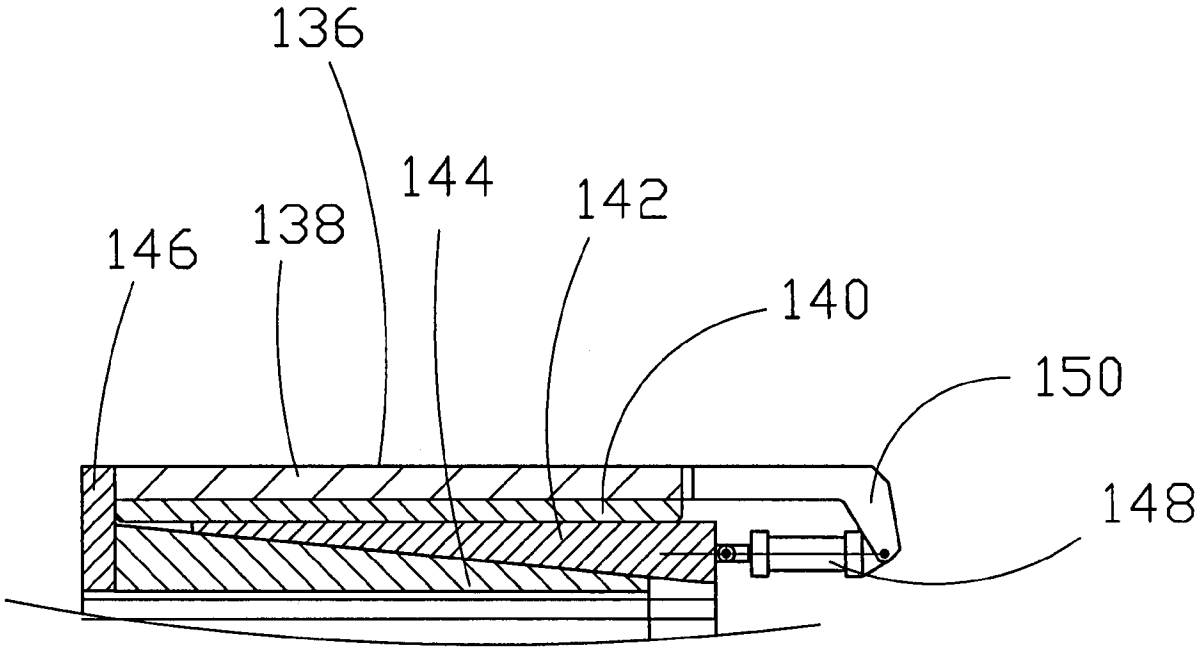
Figure 18A:
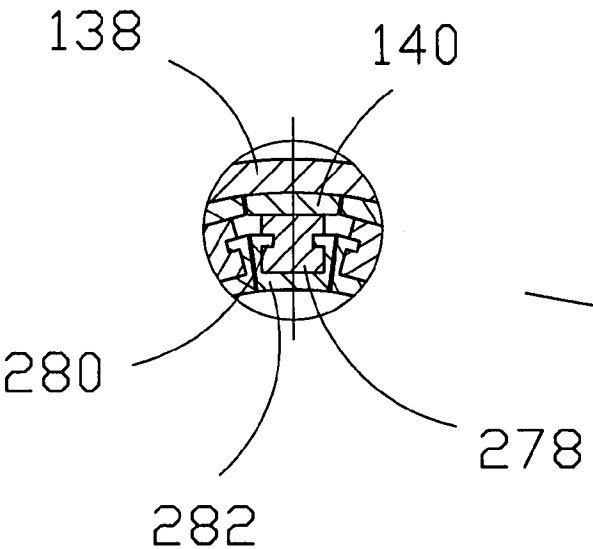

As shown in FIGS. 18*a* and 18*b*, in another embodiment of the invention, the bolts 158 and the springs 160 (i.e., such bolts and springs shown in FIG. 8*b* being included in the hydroforming apparatus 108) are replaced by a double tapered wedge 278 (instead of the tapered wedge 42) and double tapered lower cam segment 282 (instead of the lower cam segment 44) or any other suitable means so that the second taper 280 is used to move the lower cam segments 282 to the open position.

Figure 13:
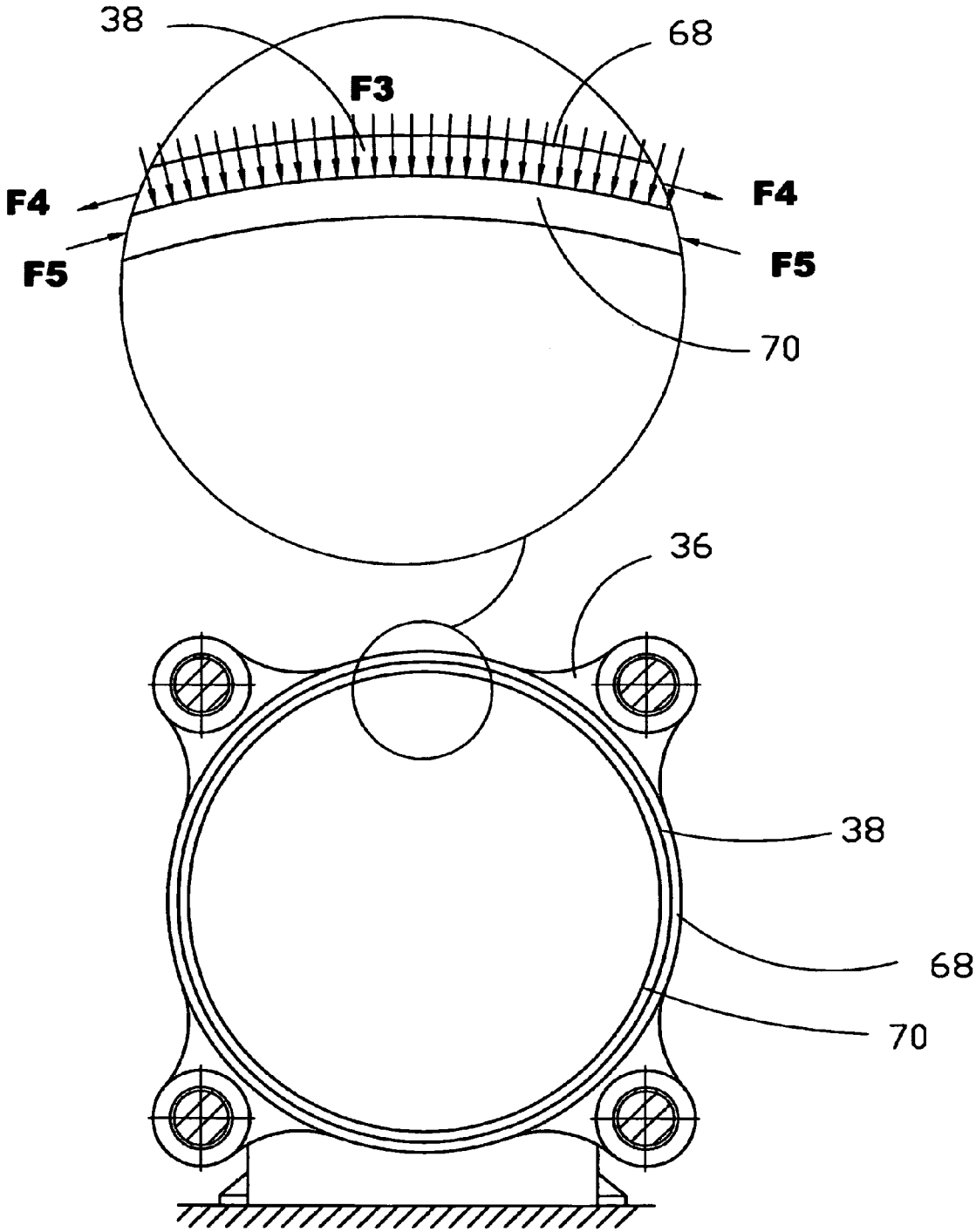
FIG. 13*a* is a plan view of two rings which are included in an embodiment of the outer ring of the invention, drawn at a smaller scale.
FIG. 13*b* is a plan view of a portion of the rings of FIG. 13*a*, drawn at a larger scale.
Figure 13B:
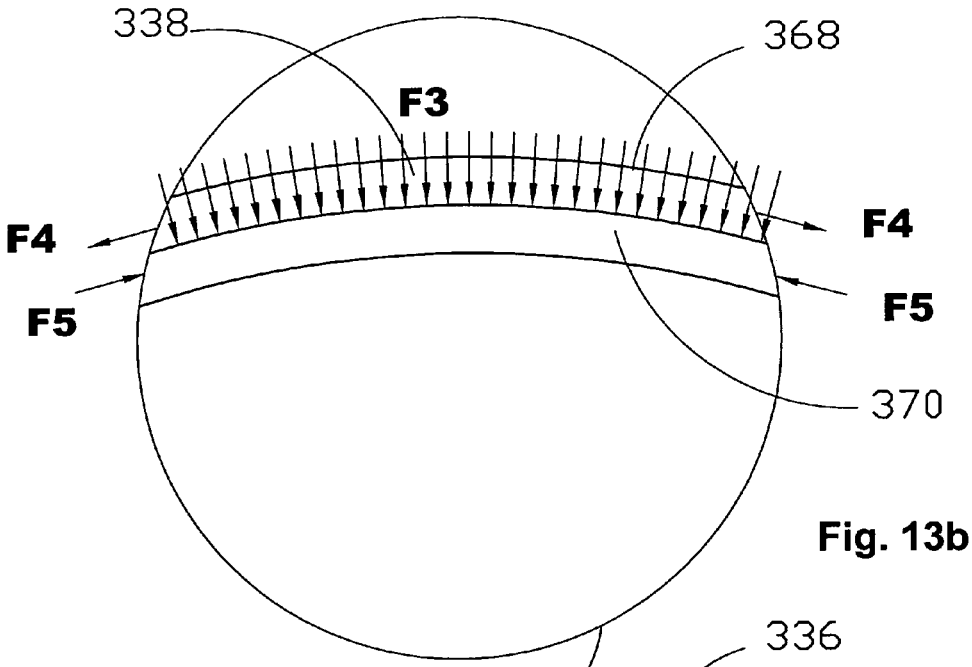
Figure 13A:
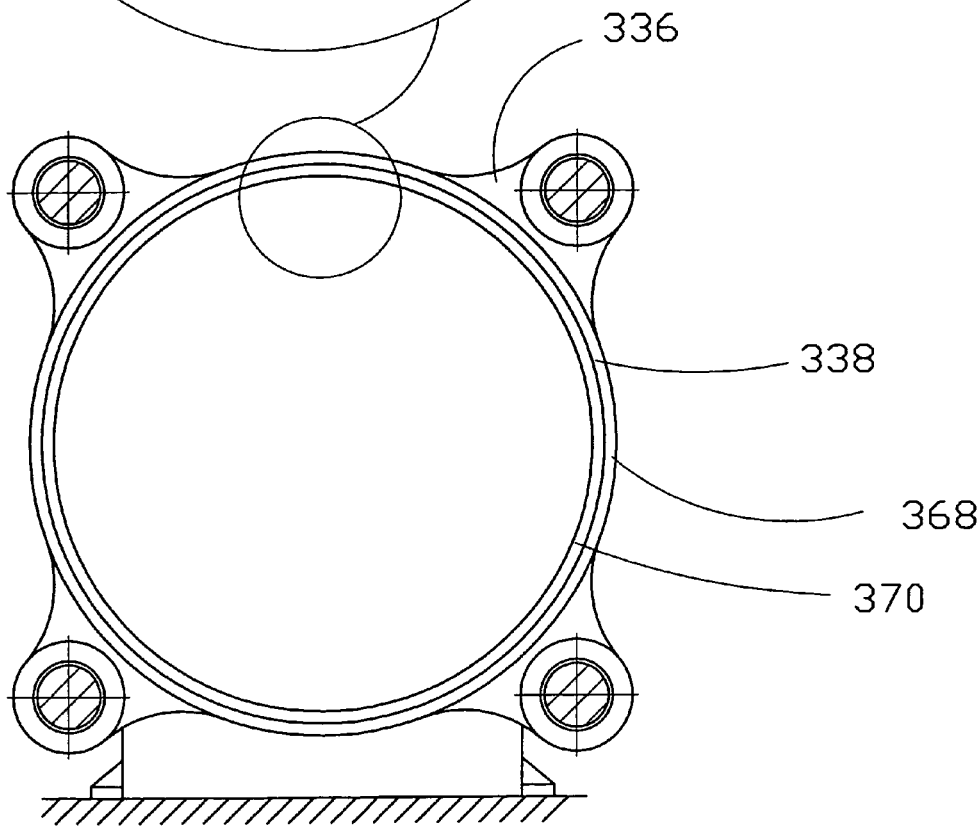

In another embodiment of the invention, an outer ring subassembly 336 includes a ring 338 which is made of two or more rings 368 and 370, as illustrated in FIGS. 13*a* and 13*b*. Preferably, the outer ring 368 is pressed over the inner ring 370 so that the outer ring 368 is exerting pressure F3 over the outer surface of the inner ring 370, and the outer ring 368 is under tension forces F4 while the inner ring 370 is under compression forces F5. The amount of the pressure F3 is such that the compression force F5 in the inner ring 370 is greater than the force F2 required to keep the die 10 closed during the hydroforming operation such that no expansion in the ring 338 occurs as a result of the hydroforming operation. Also, the energy required to keep the die 10 closed during the hydroforming operation is kept to a minimum.

Figure 14:
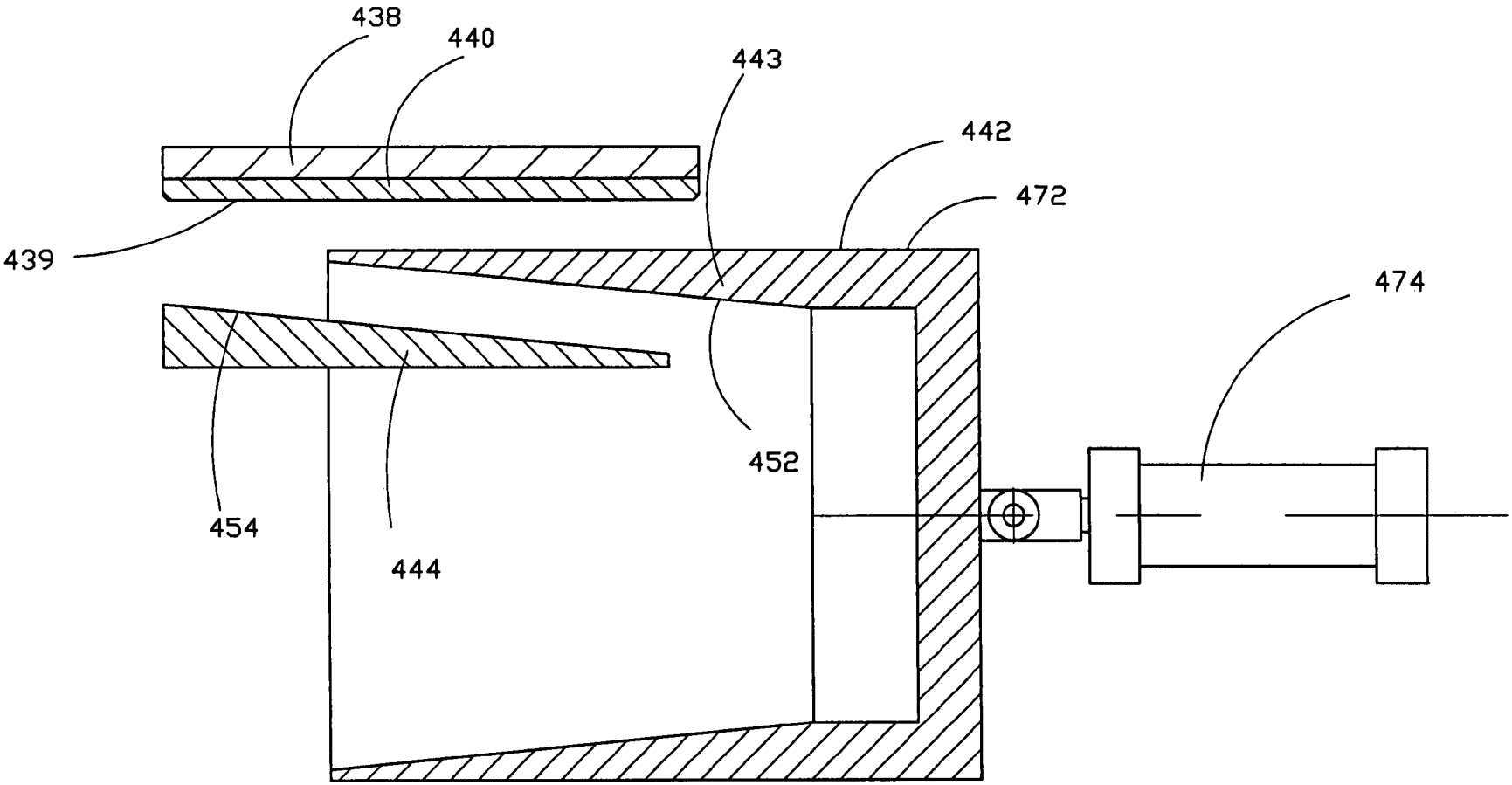
FIG. 14 is a sectional view of an alternative embodiment of a tapered wedge, drawn at a larger scale.

As shown in FIG. 14, in another embodiment of the invention, a tapered wedge 442 is made of one tapered ring 443 and moved by one cylinder 474. In this embodiment, the tapered lower surface 452 of the tapered ring 443 is cylindrical in shape and the upper tapered surface 454 of the lower cam segment 444 is also cylindrical to match the tapered and cylindrical surface 452. Similarly an outer surface 472 of the tapered ring 443 is cylindrical and matches the inner surface 439 of the outer cam segments 440.

Figure 15:
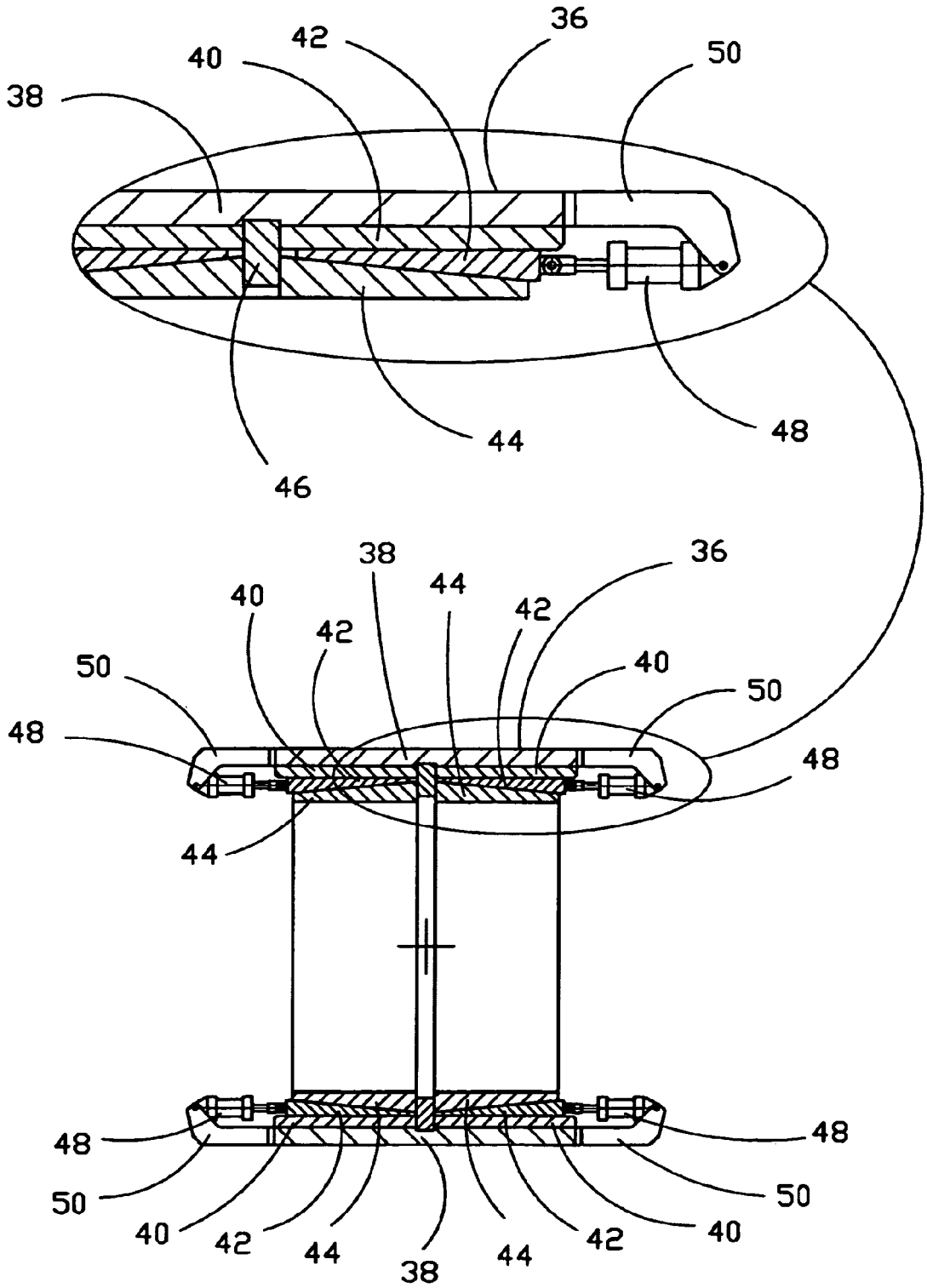
FIG. 15*a* is a sectional view of an alternative embodiment of the outer ring of the invention including two sets of tapered wedges and cylinders and upper and lower cams associated therewith, drawn at a smaller scale.
FIG. 15*b* is a sectional view of a set of the tapered wedges and cylinders of FIG. 15*a*, drawn at a larger scale.
Figures 15A, 15B:
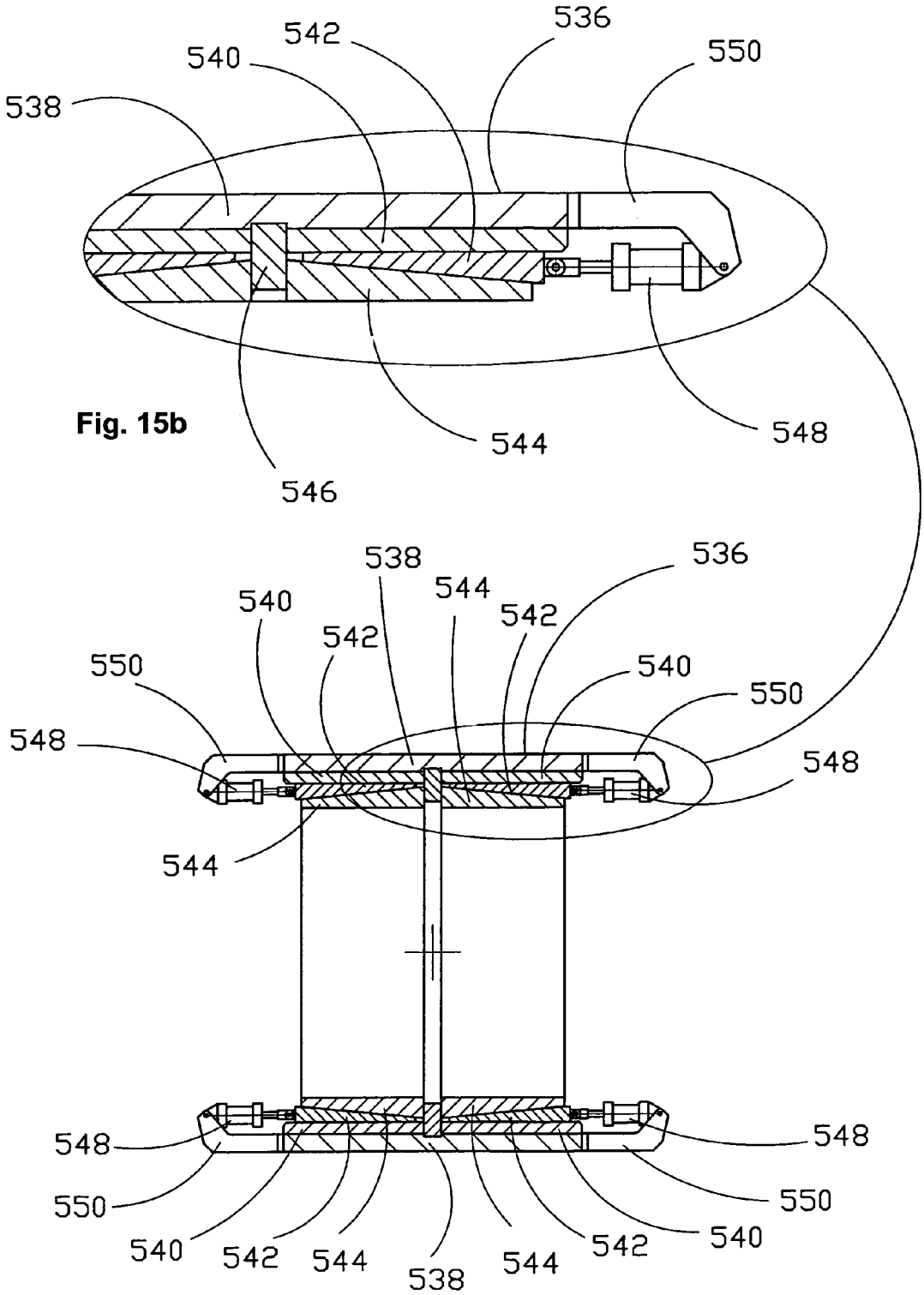

FIGS. 15*a* and 15*b* disclose another embodiment of the invention. In this embodiment, the outer ring 538 provides the tapered wedges 542 and the upper cam segments 540 and the lower cam segments 544 and the cylinders 548 and the brackets 550 from both sides of the die, as illustrated.

Figure 16:
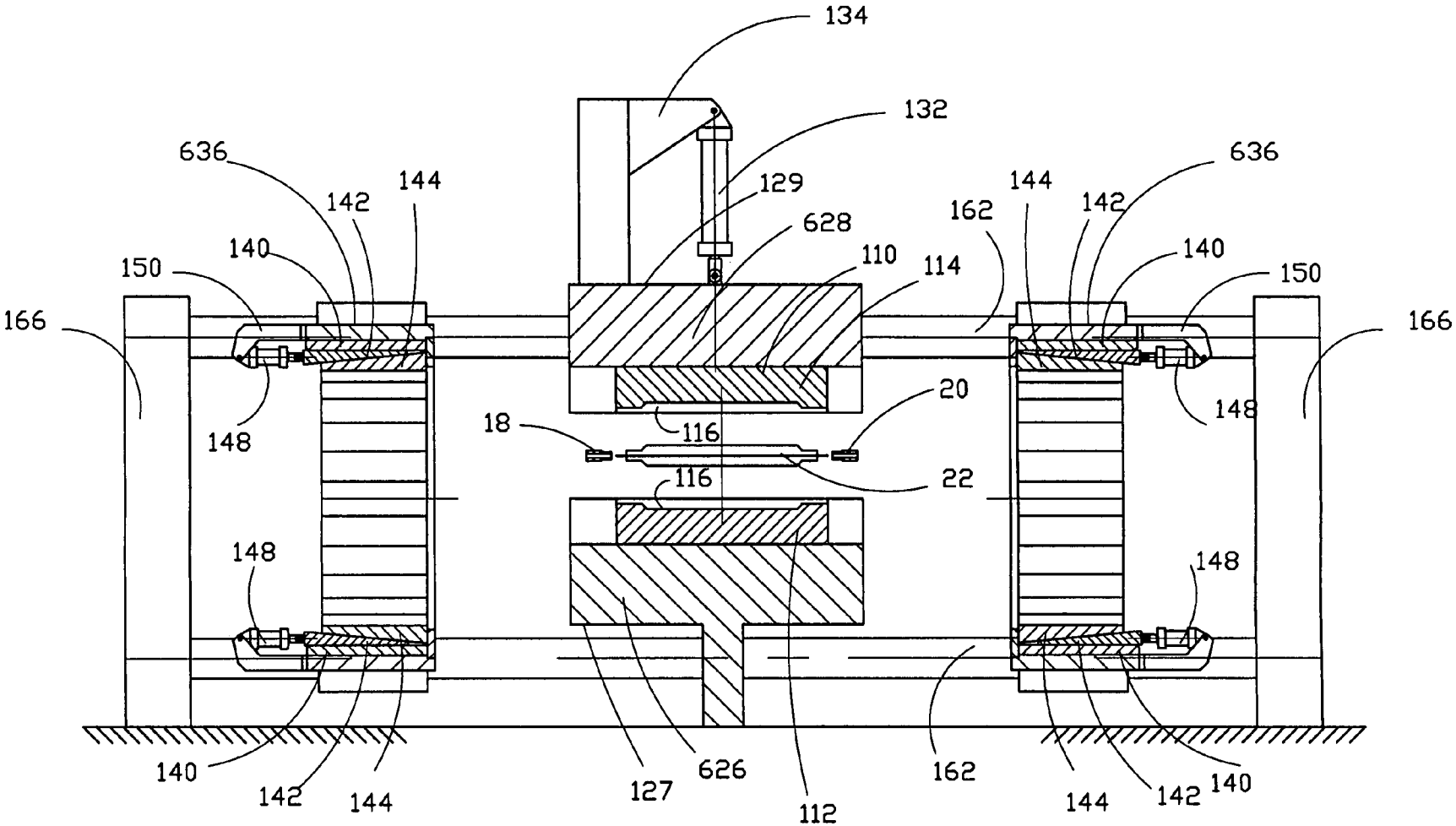
FIG. 16 is a sectional view of an embodiment of a hydroforming apparatus according to the invention with two outer rings, drawn at a smaller scale.

In another alternative embodiment of the invention it is preferred that two of the outer rings 636 (one from either side of the upper and lower die holders 626 and 628 as illustrated in FIG. 16) are provided so that the travel of the outer ring 636 between the forward and return positions is kept to a minimum.

Figure 17:
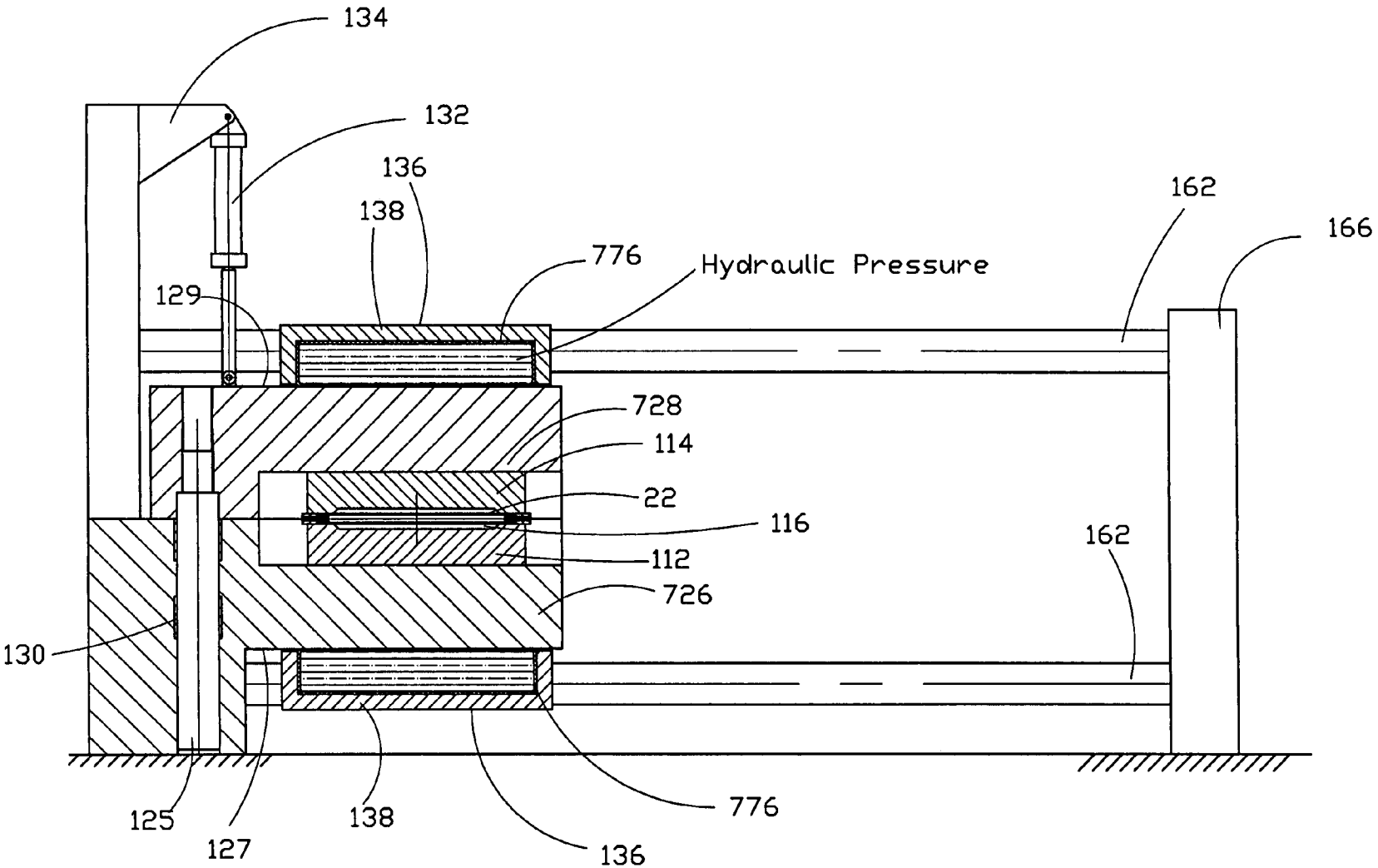
FIG. 17 is a sectional view of an alternative embodiment of a hydroforming apparatus according to the invention in which a diaphragm filled with hydraulic pressure is employed to keep the die closed.

In another embodiment of the invention a diaphragm 776 is used instead of the tapered wedges, the cylinders, and the upper and lower cam segments (FIG. 17). The diaphragm 776 is filled with hydraulic fluid and hydraulic pressure is added inside the diaphragm 776 such that the diaphragm 776 will exert force on the upper and lower die holders 726 and 728 so that the die 10 is kept in the closed position during the hydroforming operation.

The movement of the outer ring horizontally between the open and closed positions can be vertically between an upper and lower position and the die holders 728 and 726 and the die 10 are mounted vertically.

The invention describes a fixed lower die holder 26 and lower die 12 and a movable die upper holder 28 and upper die 14. Both the upper and lower die holders 26 and 28 and the upper and lower dies 12 and 14 can be movable or the upper die holder 28 and the upper die 14 are fixed while the lower die holder 26 and the lower die 12 are movable.

The invention being thus described, it will be obvious that the same may be varied in many ways. Such variations are not to be regarded as a departure from the spirit and scope of this invention, and all such modifications as would be obvious to one skilled in the art are intended to be included within the scope of the following claims.

What is claimed is:

1. A hydroforming apparatus for hydroforming a workpiece, the apparatus comprising:

a die comprising:

a lower die section mounted in a lower die holder;

an upper die section mounted on an upper die holder;

at least one of the upper and lower die holders being movable relative to the other between an open position, in which the workpiece is positionable between the upper and lower die holders, and a closed position, in which the lower and upper die sections combine to define a die cavity therebetween in which the workpiece is hydroformed;

each of the upper and lower die holders comprising an outer surface respectively;

an outer ring subassembly comprising:

a ring;

at least one first cam segment attached to an inner surface of the ring;

at least one second cam segment;

at least one tapered wedge positioned between said at least one first and second cam segments;

the second cam segment being movable between an open position, in which the second cam segment is disposed distal to the first cam segment, and a closed position, in which the second cam segment is disposed proximal to the second cam segment;

at least one biasing means for biasing said at least one second cam segment to the closed position;

said at least one tapered wedge being movable between an extended position, in which said at least one second cam segment is pushed by said at least one tapered wedge to the open position, and a retracted position, in which said at least one second cam segment is moved to the closed position by said at least one biasing means;

said at least one second cam segment including a lower surface shaped to engage the outer surface of the upper and lower die holders; and the outer ring subassembly being movable between a forward position, in which the lower surface of said at least one second cam segment engages the outer surface upon said at least one tapered wedge moving to the extended position, and a returned position, in which the lower surface is disengaged from the outer surface.

2. A hydroforming apparatus according to claim 1 in which the outer surfaces of the upper and lower die holders cooperate to form a cylindrical shape when the upper and lower die holders are combined.

3. A hydroforming apparatus according to claim 1 additionally comprising at least one hydraulic cylinder for moving said at least one tapered wedge between the retracted position and the extended position.

4. A hydroforming apparatus according to claim 3 in which said at least one hydraulic cylinder exerts a first force directed in a first direction on said at least one tapered wedge to move said at least one tapered wedge to the extended position.

5. A hydroforming apparatus according to claim 4 in which:

said at least one tapered wedge comprises a substantially planar contact surface;

said at least one second cam segment comprises a substantially planar mating surface, upon movement of said at least one tapered wedge to the extended position, the contact surface and the mating surface engage each other substantially on a contact plane; and the contact plane defines an acute angle between the contact plane and the first direction such that, upon movement of said at least one tapered wedge to the extended position, a second force is transmitted which is directed toward the outer surface and perpendicular to the first direction, to assist in holding the upper and lower die holders together during hydroforming.

6. A hydroforming apparatus according to claim 1 in which the outer ring subassembly is movable along guide rods between the forward position and the returned position.

* * * * *